US006526777B1

(12) United States Patent
Campbell et al.

(10) Patent No.: US 6,526,777 B1
(45) Date of Patent: Mar. 4, 2003

(54) LNG PRODUCTION IN CRYOGENIC NATURAL GAS PROCESSING PLANTS

(75) Inventors: Roy E. Campbell, deceased, late of Midland, TX (US), by Wanda P. Campbell, Executrix; John D. Wilkinson, Midland, TX (US); Hank M. Hudson, Midland, TX (US); Kyle T. Cuellar, Katy, TX (US)

(73) Assignee: Elcor Corporation, Dallas, TX (US)

( * ) Notice: Subject to any disclaimer, the term of this patent is extended or adjusted under 35 U.S.C. 154(b) by 0 days.

(21) Appl. No.: 09/839,907

(22) Filed: Apr. 20, 2001

(51) Int. Cl.[7] ..... F25J 3/02
(52) U.S. Cl. ..... 62/621; 62/625
(58) Field of Search ..... 62/621, 625

(56) References Cited

U.S. PATENT DOCUMENTS

| | | | |
|---|---|---|---|
| 3,292,380 | A | 12/1966 | Bucklin |
| 4,140,504 | A | 2/1979 | Campbell et al. |
| 4,157,904 | A | 6/1979 | Campbell et al. |
| 4,171,964 | A | 10/1979 | Campbell et al. |
| 4,185,978 | A | 1/1980 | McGalliard et al. |
| 4,251,249 | A | 2/1981 | Gulsby |
| 4,278,457 | A | 7/1981 | Campbell et al. |
| 4,519,824 | A | 5/1985 | Huebel |
| 4,617,039 | A | 10/1986 | Buck |
| 4,687,499 | A | 8/1987 | Aghili |
| 4,689,063 | A | 8/1987 | Paradowski et al. |
| 4,690,702 | A | 9/1987 | Paradowski et al. |
| 4,710,214 | A | 12/1987 | Sharma et al. |
| 4,854,955 | A | 8/1989 | Campbell et al. |
| 4,869,740 | A | 9/1989 | Campbell et al. |
| 4,889,545 | A | 12/1989 | Campbell et al. |
| 4,895,584 | A | 1/1990 | Buck et al. |
| RE33,408 | E | 10/1990 | Khan et al. |

FOREIGN PATENT DOCUMENTS

| | | |
|---|---|---|
| WO | 9847839 | 10/1998 |
| WO | 0033006 | 6/2000 |

OTHER PUBLICATIONS

Finn, Adrian, J., Grant L. Johnson, and Terry R. Tomlinson, "LNG Technology for Offshore and Mid–Scale Plant", Proceedings of the Seventy–Ninth Annual Convention of the Gas Processors Association, pp. 429–450, Atlanta, Georgia, Mar. 13–15, 2000.

Price, Brian C., "LNG Production for Peak Shaving Operations", Proceedings of the Seventy–Eighth Annual Convention of the Gas Processors Association, pp. 273–280, Nashville, Tennessee, Mar. 1–3, 1999.

(List continued on next page.)

*Primary Examiner*—Ronald Capossela
(74) *Attorney, Agent, or Firm*—Baker Botts LLP

(57) ABSTRACT

A process for liquefying natural gas in conjunction with processing natural gas to recover natural gas liquids (NGL) is disclosed. In the process, the natural gas stream to be liquefied is taken from one of the streams in the NGL recovery plant and cooled under pressure to condense it. A distillation stream is withdrawn from the NGL recovery plant to provide some of the cooling required to condense the natural gas stream. The condensed natural gas stream is expanded to an intermediate pressure and supplied to a mid-column feed point on a distillation column. The bottom product from this distillation column preferentially contains the majority of any hydrocarbons heavier than methane that would otherwise reduce the purity of the liquefied natural gas, and is routed to the NGL recovery plant so that these heavier hydrocarbons can be recovered in the NGL product. The overhead vapor from the distillation column is cooled and condensed, and a portion of the condensed stream is supplied to a top feed point on the distillation column to serve as reflux. A second portion of the condensed stream is expanded to low pressure to form the liquefied natural gas stream.

21 Claims, 8 Drawing Sheets

U.S. PATENT DOCUMENTS

| | | | |
|---|---|---|---|
| 5,275,005 | A | 1/1994 | Campbell et al. |
| 5,363,655 | A | 11/1994 | Kikkawa et al. |
| 5,555,748 | A | 9/1996 | Campbell et al. |
| 5,566,554 | A | 10/1996 | Vijayaraghavan et al. |
| 5,568,737 | A | 10/1996 | Campbell et al. |
| 5,600,969 | A | 2/1997 | Low |
| 5,615,561 | A | 4/1997 | Houshmand et al. |
| 5,755,155 | A | 5/1998 | Buesing |
| 5,771,712 | A | 6/1998 | Campbell et al. |
| 5,795,380 | A | 8/1998 | Billings et al. |
| 5,799,507 | A | 9/1998 | Wilkinson et al. |
| 5,881,569 | A | 3/1999 | Campbell et al. |
| 5,890,378 | A | 4/1999 | Rambo et al. |
| 5,983,664 | A | 11/1999 | Campbell et al. |
| 6,109,061 | A | 8/2000 | Gaskin |
| 6,182,468 | B1 | 2/2001 | Stothers |
| 6,182,469 | B1 | 2/2001 | Campbell et al. |

LNG PRODUCTION IN CRYOGENIC NATURAL GAS PROCESSING PLANTS

BACKGROUND OF THE INVENTION

This invention relates to a process for processing natural gas to produce liquefied natural gas (LNG) that has a high methane purity. In particular, this invention is well suited to co-production of LNG by integration into natural gas processing plants that recover natural gas liquids (NGL) and/or liquefied petroleum gas (LPG) using a cryogenic process.

Natural gas is typically recovered from wells drilled into underground reservoirs. It usually has a major proportion of methane, i.e., methane comprises at least 50 mole percent of the gas. Depending on the particular underground reservoir, the natural gas also contains relatively lesser amounts of heavier hydrocarbons such as ethane, propane, butanes, pentanes and the like, as well as water, hydrogen, nitrogen, carbon dioxide, and other gases.

Most natural gas is handled in gaseous form. The most common means for transporting natural gas from the wellhead to gas processing plants and thence to the natural gas consumers is in high pressure gas transmission pipelines. In a number of circumstances, however, it has been found necessary and/or desirable to liquefy the natural gas either for transport or for use. In remote locations, for instance, there is often no pipeline infrastructure that would allow for convenient transportation of the natural gas to market. In such cases, the much lower specific volume of LNG relative to natural gas in the gaseous state can greatly reduce transportation costs by allowing delivery of the LNG using cargo ships and transport trucks.

Another circumstance that favors the liquefaction of natural gas is for its use as a motor vehicle fuel. In large metropolitan areas, there are fleets of buses, taxi cabs, and trucks that could be powered by LNG if there were an economic source of LNG available. Such LNG-fueled vehicles produce considerably less air pollution due to the clean-burning nature of natural gas when compared to similar vehicles powered by gasoline and diesel engines which combust higher molecular weight hydrocarbons. In addition, if the LNG is of high purity (i.e., with a methane purity of 95 mole percent or higher), the amount of carbon dioxide (a "greenhouse gas") produced is considerably less due to the lower carbon:hydrogen ratio for methane compared to all other hydrocarbon fuels.

The present invention is generally concerned with the liquefaction of natural gas as a co-product in a cryogenic gas processing plant that also produces natural gas liquids (NGL) such as ethane, propane, butanes, and heavier hydrocarbon components. A typical analysis of a natural gas stream to be processed in accordance with this invention would be, in approximate mole percent, 92.6% methane, 4.7% ethane and other $C_2$ components, 1.0% propane and other $C_3$ components, 0.2% iso-butane, 0.2% normal butane, 0.1% pentanes plus, with the balance made up of nitrogen and carbon dioxide. Sulfur containing gases are also sometimes present.

There are a number of methods known for liquefying natural gas. For instance, see Finn, Adrian J., Grant L. Johnson, and Terry R. Tomlinson, "LNG Technology for Offshore and Mid-Scale Plants", Proceedings of the Seventy-Ninth Annual Convention of the Gas Processors Association, pp. 429–450, Atlanta, Ga., Mar. 13–15, 2000 for a survey of a number of such processes. U.S. Pat. Nos. 5,363,655; 5,600,969; and 5,615,561 also describe relevant processes. These methods generally include steps in which the natural gas is purified (by removing water and troublesome compounds such as carbon dioxide and sulfur compounds), cooled, condensed, and expanded. Cooling and condensation of the natural gas can be accomplished in many different manners. "Cascade refrigeration" employs heat exchange of the natural gas with several refrigerants having successively lower boiling points, such as propane, ethane, and methane. As an alternative, this heat exchange can be accomplished using a single refrigerant by evaporating the refrigerant at several different pressure levels. "Multi-component refrigeration" employs heat exchange of the natural gas with a single refrigerant fluid composed of several refrigerant components in lieu of multiple single-component refrigerants. Expansion of the natural gas can be accomplished both isenthalpically (using Joule-Thomson expansion, for instance) and isentropically (using a work-expansion turbine, for instance).

While any of these methods could be employed to produce vehicular grade LNG, the capital and operating costs associated with these methods have generally made the installation of such facilities uneconomical. For instance, the purification steps required to remove water, carbon dioxide, sulfur compounds, etc. from the natural gas prior to liquefaction represent considerable capital and operating costs in such facilities, as do the drivers for the refrigeration cycles employed. This has led the inventors to investigate the feasibility of integrating LNG production into cryogemc gas processing plants used to recover NGL from natural gas. Such an integrated LNG production method would eliminate the need for separate gas purification facilities and gas compression drivers. Further, the potential for integrating the cooling/condensation for the LNG liquefaction with the process cooling required for NGL recovery could lead to significant efficiency improvements in the LNG liquefaction method.

In accordance with the present invention, it has been found that LNG with a methane purity in excess of 99 percent can be co-produced from a cryogenic NGL recovery plant without increasing its energy requirements and without reducing the NGL recovery level. The present invention, although applicable at lower pressures and warmer temperatures, is particularly advantageous when processing feed gases in the range of 400 to 1500 psia [2,758 to 10,342 kPa(a)] or higher under conditions requiring NGL recovery column overhead temperatures of −50° F. [−46° C.] or colder.

For a better understanding of the present invention, reference is made to the following examples and drawings. Referring to the drawings:

FIG. 1 is a flow diagram of a prior art cryogenic natural gas processing plant in accordance with U.S. Pat. No. 4,278,457;

FIG. 2 is a flow diagram of said cryogenic natural gas processing plant when adapted for co-production of LNG in accordance with a prior art process;

FIG. 3 is a flow diagram of said cryogenic natural gas processing plant when adapted for co-production of LNG using a prior art process in accordance with U.S. Pat. No. 5,615,561;

In the following explanation of the above figures, tables are provided summarizing flow rates calculated for representative process conditions. In the tables appearing herein, the values for flow rates (in moles per hour) have been rounded to the nearest whole number for convenience. The total stream rates shown in the tables include all non-hydrocarbon components and hence are generally larger than the sum of the stream flow rates for the hydrocarbon components. Temperatures indicated are approximate values rounded to the nearest degree. It should also be noted that the process design calculations performed for the purpose of comparing the processes depicted in the figures are based on the assumption of no heat leak from (or to) the surroundings to (or from) the process. The quality of commercially available insulating materials makes this a very reasonable assumption and one that is typically made by those skilled in the art.

For convenience, process parameters are reported in both the traditional British units and in the units of the International System of Units (SI). The molar flow rates given in the tables may be interpreted as either pound moles per hour or kilogram moles per hour. The energy consumptions reported as horsepower (HP) and/or thousand British Thermal Units per hour (MBTU/H) correspond to the stated molar flow rates in pound moles per hour. The energy consumptions reported as kilowatts (kW) correspond to the stated molar flow rates in kilogram moles per hour. The LNG production rates reported as gallons per day (gallons/D) and/or pounds per hour (Lbs/hour) correspond to the stated molar flow rates in pound moles per hour. The LNG production rates reported as cubic meters per hour ($m^3$/H) and/or kilograms per hour (kg/H) correspond to the stated molar flow rates in kilogram moles per hour.

DESCRIPTION OF THE PRIOR ART

Figure 1:
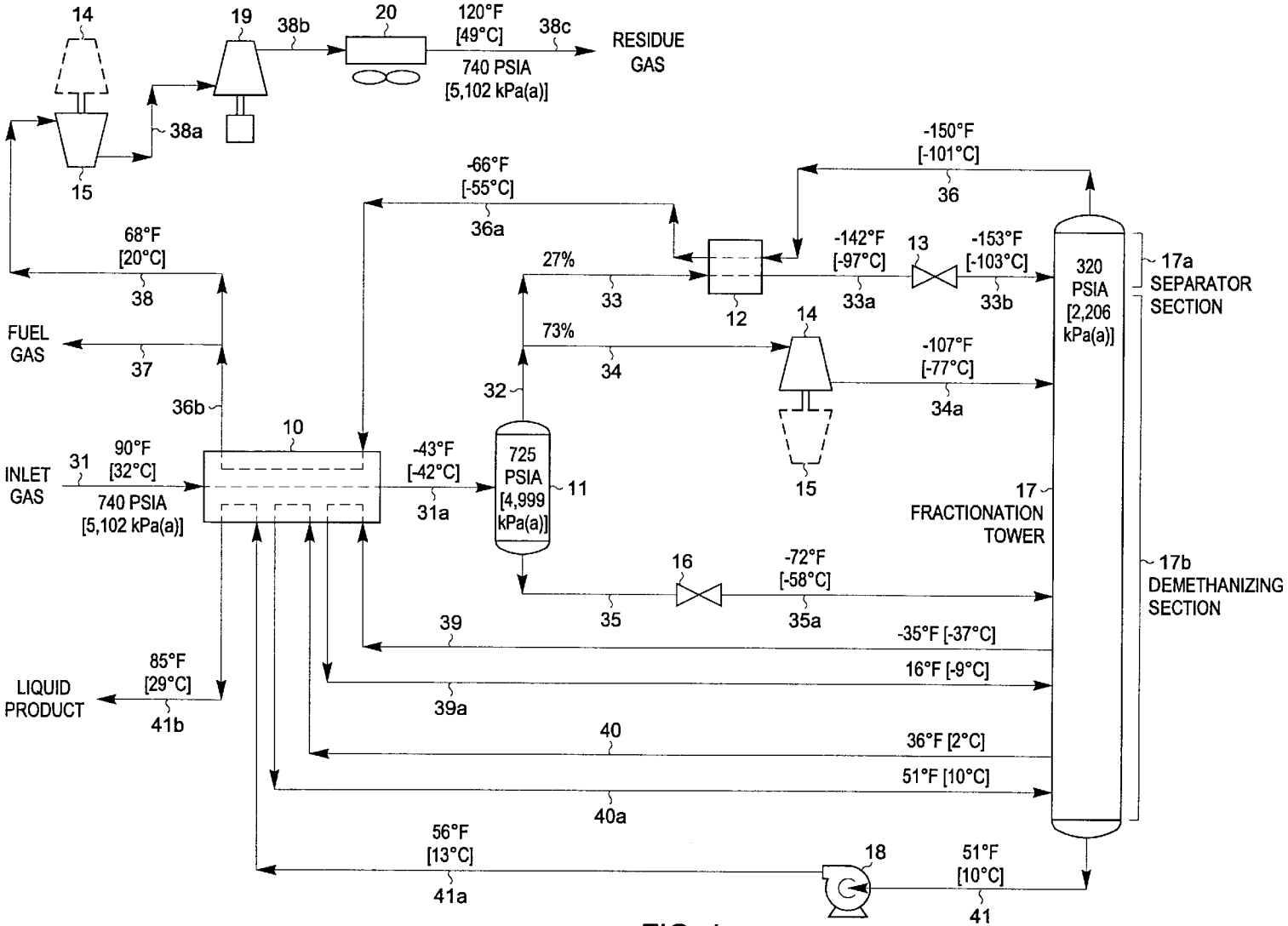
FIG. 1 (PRIOR ART)

Referring now to FIG. 1, for comparison purposes we begin with an example of an NGL recovery plant that does not co-produce LNG. In this simulation of a prior art NGL recovery plant according to U.S. Pat. No. 4,278,457, inlet gas enters the plant at 90° F. [32° C.] and 740 psia [5,102 kPa(a)] as stream 31. If the inlet gas contains a concentration of carbon dioxide and/or sulfur compounds which would prevent the product streams from meeting specifications, these compounds are removed by appropriate pretreatment of the feed gas (not illustrated). In addition, the feed stream is usually dehydrated to prevent hydrate (ice) formation under cryogenic conditions. Solid desiccant has typically been used for this purpose.

The feed stream 31 is cooled in heat exchanger 10 by heat exchange with cool demethanizer overhead vapor at −66° F. [−55° C.] (stream 36*a*), bottom liquid product at 56° F. [13° C.] (stream 41*a*) from demethanizer bottoms pump 18, demethanizer reboiler liquids at 36° F. [2° C.] (stream 40), and demethanizer side reboiler liquids at −35° F. [−37° C.] (stream 39). Note that in all cases heat exchanger 10 is representative of either a multitude of individual heat exchangers or a single multi-pass heat exchanger, or any combination thereof. (The decision as to whether to use more than one heat exchanger for the indicated cooling services will depend on a number of factors including, but not limited to, inlet gas flow rate, heat exchanger size, stream temperatures, etc.) The cooled stream 31*a* enters separator 11 at −43° F. [42° C.] and 725 psia [4,999 kPa(a)] where the vapor (stream 32) is separated from the condensed liquid (stream 35).

The vapor (stream 32) from separator 11 is divided into two streams, 33 and 34. Stream 33, containing about 27% of the total vapor, passes through heat exchanger 12 in heat exchange relation with the demethanizer overhead vapor stream 36, resulting in cooling and substantial condensation of stream 33*a*. The substantially condensed stream 33*a* at −142° F. [97° C.] is then flash expanded through an appropriate expansion device, such as expansion valve 13, to the operating pressure (approximately 320 psia [2,206 kPa(a)]) of fractionation tower 17. During expansion a portion of the stream is vaporized, resulting in cooling of the total stream. In the process illustrated in FIG. 1, the expanded stream 33*b* leaving expansion valve 13 reaches a temperature of −153° F. [−103° C.], and is supplied to separator section 17*a* in the upper region of fractionation tower 17. The liquids separated therein become the top feed to demethanizing section 17*b*.

The remaining 73% of the vapor from separator 11 (stream 34) enters a work expansion machine 14 in which mechanical energy is extracted from this portion of the high pressure feed. The machine 14 expands the vapor substantially isentropically from a pressure of about 725 psia [4,999 kPa(a)] to the tower operating pressure, with the work expansion cooling the expanded stream 34*a* to a temperature of approximately −107° F. [−77° C.]. The typical commercially available expanders are capable of recovering on the order of 80–85% of the work theoretically available in an ideal isentropic expansion. The work recovered is often used to drive a centrifugal compressor (such as item 15), that can be used to re-compress the residue gas (stream 38), for example. The expanded and partially condensed stream 34*a* is supplied as feed to the distillation column at an intermediate point. The separator liquid (stream 35) is likewise expanded to the tower operating pressure by expansion valve 16, cooling stream 35*a* to −72° F. [−58° C.] before it is supplied to the demethanizer in fractionation tower 17 at a lower mid-column feed point.

The demethanizer in fractionation tower 17 is a conventional distillation column containing a plurality of vertically spaced trays, one or more packed beds, or some combination of trays and packing. As is often the case in natural gas processing plants, the fractionation tower may consist of two sections. The upper section 17*a* is a separator wherein the partially vaporized top feed is divided into its respective vapor and liquid portions, and wherein the vapor rising from the lower distillation or demethanizing section 17*b* is combined with the vapor portion of the top feed to form the cold demethanizer overhead vapor (stream 36) which exits the top of the tower at −150° F. [−101° C.]. The lower, demethanizing section 17*b* contains the trays and/or packing and provides the necessary contact between the liquids falling downward and the vapors rising upward. The demethanizing section also includes reboilers which heat and vaporize a portion of the liquids flowing down the column to provide the stripping vapors which flow up the column.

The liquid product stream 41 exits the bottom of the tower at 51° F. [10° C.], based on a typical specification of a methane to ethane ratio of 0.028:1 on a molar basis in the bottom product. The stream is pumped to approximately 650 psia [4,482 kPa(a)] (stream 41*a*) in pump 18. Stream 41*a*, now at about 56° F. [13° C.], is warmed to 85° F. [29° C.] (stream 41*b*) in heat exchange 10 as it provides cooling to stream 31. (The discharge pressure of the pump is usually set by the ultimate destination of the liquid product. Generally the liquid product flows to storage and the pump discharge pressure is set so as to prevent any vaporization of stream 41*b* as it is warmed in heat exchanger 10.)

The demethanizer overhead vapor (stream 36) passes countercurrently to the incoming feed gas in heat exchanger 12 where it is heated to −66° F. [−55° C.] (stream 36*a*), and heat exchanger 10 where it is heated to 68° F. [20° C.] (stream 36*b*). A portion of the warmed demethanizer overhead vapor is withdrawn to serve as fuel gas (stream 37) for the plant, with the remainder becoming the residue gas (stream 38). (The amount of fuel gas that must be withdrawn is largely determined by the fuel required for the engines and/or turbines driving the gas compressors in the plant, such as compressor 19 in this example.) The residue gas is re-compressed in two stages. The first stage is compressor 15 driven by expansion machine 14. The second stage is compressor 19 driven by a supplemental power source which compresses the residue gas (stream 38*b*) to sales line pressure. After cooling to 120° F. [49° C.] in discharge cooler 20, the residue gas product (stream 38*c*) flows to the sales gas pipeline at 740 psia [5,102 kPa(a)], sufficient to meet line requirements (usually on the order of the inlet pressure).

A summary of stream flow rates and energy consumption for the process illustrated in FIG. 1 is set forth in the following table:

TABLE I (FIG. 1)
Stream Flow Summary - Lb. Moles/Hr [kg moles/Hr]

| Stream | Methane | Ethane | Propane | Butanes+ | Total |
|---|---|---|---|---|---|
| 31 | 35,473 | 1,689 | 585 | 331 | 38,432 |
| 32 | 35,210 | 1,614 | 498 | 180 | 37,851 |
| 35 | 263 | 75 | 87 | 151 | 580 |
| 33 | 9,507 | 436 | 134 | 49 | 10,220 |
| 34 | 25,704 | 1,178 | 363 | 132 | 27,631 |
| 36 | 35,432 | 211 | 6 | 0 | 35,951 |
| 37 | 531 | 3 | 0 | 0 | 539 |
| 38 | 34,901 | 208 | 6 | 0 | 35,412 |
| 41 | 41 | 1,478 | 578 | 330 | 2,481 |
| Recoveries* | | | | | |
| Ethane | | | 87.52% | | |
| Propane | | | 98.92% | | |
| Butanes+ | | | 99.89% | | |
| Power | | | | | |
| Residue Gas Compression | | | 14,517 HP | [23,866 kW] | |

*(Based on un-rounded flow rates)

Figure 2:
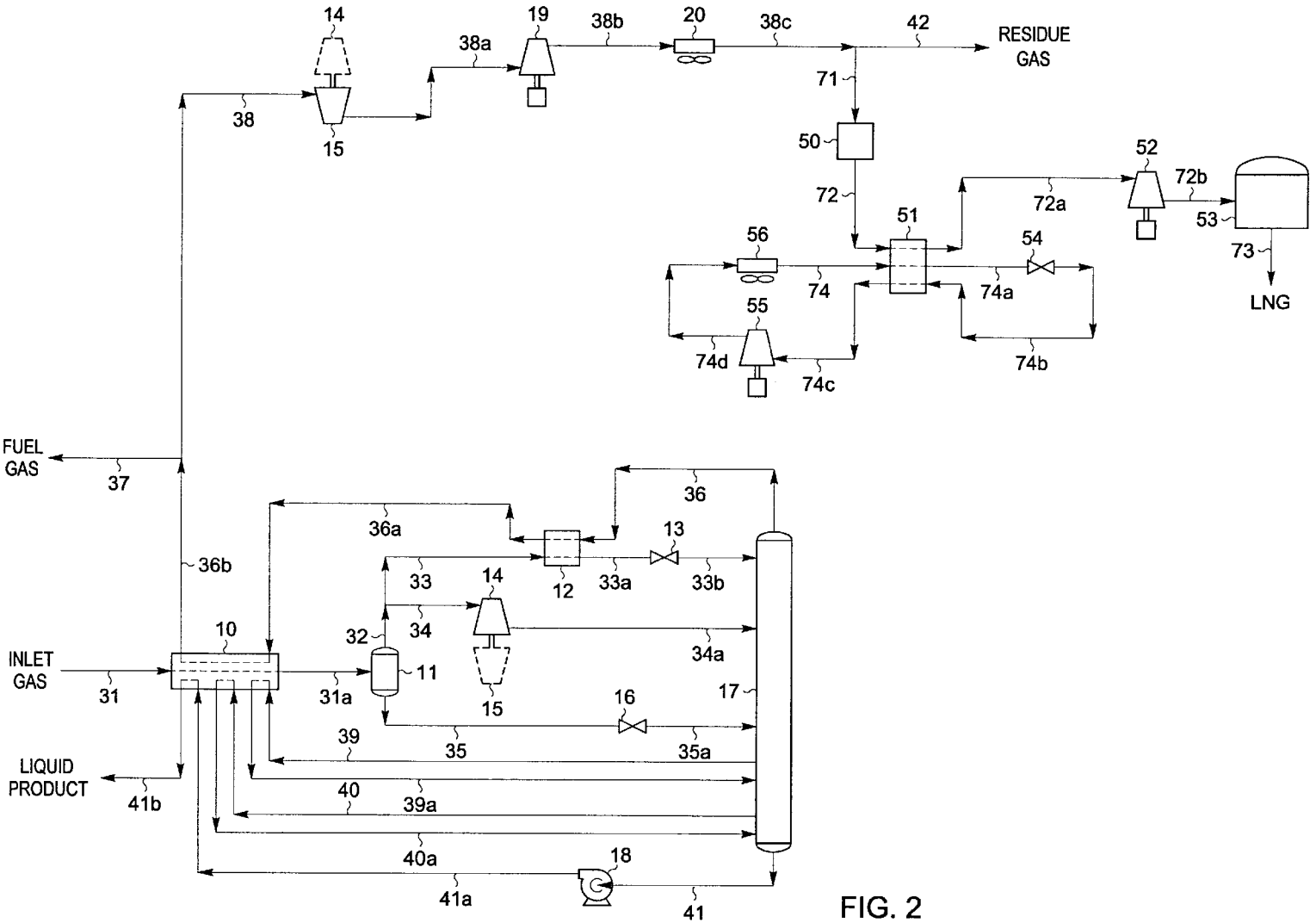
FIG. 2 (PRIOR ART)

FIG. 2 shows one manner in which the NGL recovery plant in FIG. 1 can be adapted for co-production of LNG, in this case by application of a prior art process for LNG production similar to that described by Price (Price, Brian C. "LNG Production for Peak Shaving Operations", Proceedings of the Seventy-Eighth Annual Convention of the Gas Processors Association, pp. 273–280, Atlanta, Ga., Mar. 13–15, 2000). The inlet gas composition and conditions considered in the process presented in FIG. 2 are the same as those in FIG. 1. In this example and all that follow, the simulation is based on co-production of a nominal 50,000 gallons/D [417 $m^3$/D] of LNG, with the volume of LNG measured at flowing (not standard) conditions.

In the simulation of the FIG. 2 process, the inlet gas cooling, separation, and expansion scheme for the NGL recovery plant is exactly the same as that used in FIG. 1. In this case, the compressed and cooled demethanizer overhead vapor (stream 38*c*) produced by the NGL recovery plant is divided into two portions. One portion (stream 42) is the residue gas for the plant and is routed to the sales gas pipeline. The other portion (stream 71) becomes the feed stream for the LNG production plant.

The inlet gas to the NGL recovery plant (stream 31) was not treated for carbon dioxide removal prior to processing. Although the carbon dioxide concentration in the inlet gas (about 0.5 mole percent) will not create any operating problems for the NGL recovery plant, a significant fraction of this carbon dioxide will leave the plant in the demethanizer overhead vapor (stream 36) and will subsequently contaminate the feed stream for the LNG production section (stream 71). The carbon dioxide concentration in this stream is about 0.4 mole percent, well in excess of the concentration that can be tolerated by this prior art process (about 0.005 mole percent). Accordingly, the feed stream 71 must be processed in carbon dioxide removal section 50 before entering the LNG production section to avoid operating problems from carbon dioxide freezing. Although there are many different processes that can be used for carbon dioxide removal, many of them will cause the treated gas stream to become partially or completely saturated with water. Since water in the feed stream would also lead to freezing problems in the LNG production section, it is very likely that the carbon dioxide removal section 50 must also include dehydration of the gas stream after treating.

The treated feed gas enters the LNG production section at 120° F. [49° C.] and 730 psia [5,033 kPa(a)] as stream 72 and is cooled in heat exchanger 51 by heat exchange with a refrigerant mixture at −261° F. [−163° C.] (stream 74*b*). The purpose of heat exchanger 51 is to cool the feed stream to substantial condensation and, preferably, to subcool the stream so as to eliminate any flash vapor being generated in the subsequent expansion step. For the conditions stated, however, the feed stream pressure is above the cricondenbar, so no liquid will condense as the stream is cooled. Instead, the cooled stream 72*a* leaves heat exchanger 51 at −256° F. [−160° C.] as a dense-phase fluid. (The cricondenbar is the maximum pressure at which a vapor phase can exist in a multi-phase fluid. At pressures below the cricondenbar, stream 72*a* would typically exit heat exchanger 51 as a subcooled liquid stream.)

Stream 72*a* enters a work expansion machine 52 in which mechanical energy is extracted from this high pressure stream. The machine 52 expands the dense-phase fluid substantially isentropically from a pressure of about 728 psia [5,019 kPa(a)] to the LNG storage pressure (18 psia [124 kPa(a)]), slightly above atmospheric pressure. The work expansion cools the expanded stream 72*b* to a temperature of approximately −257° F. [−160° C.], whereupon it is then directed to the LNG storage tank 53 which holds the LNG product (stream 73).

All of the cooling for stream 72 is provided by a closed cycle refrigeration loop. The working fluid for this cycle is a mixture of hydrocarbons and nitrogen, with the composition of the mixture adjusted as needed to provide the required refrigerant temperature while condensing at a reasonable pressure using the available cooling medium. In this case, condensing with ambient air has been assumed, so a refrigerant mixture composed of nitrogen, methane, ethane, propane, and heavier hydrocarbons is used in the simulation of the FIG. 2 process. The composition of the stream, in approximate mole percent, is 5.2% nitrogen, 24.6% methane, 24.1% ethane, and 18.0% propane, with the balance made up of heavier hydrocarbons.

The refrigerant stream 74 leaves partial condenser 56 at 120° F. [49° C.] and 140 psia [965 kPa(a)]. It enters heat exchanger 51 and is condensed and then subcooled to −256° F. [−160° C.] by the flashed refrigerant stream 74*b*. The subcooled liquid stream 74*a* is flash expanded substantially isenthalpically in expansion valve 54 from about 138 psia [951 kPa(a)] to about 26 psia [179 kPa(a)]. During expansion a portion of the stream is vaporized, resulting in cooling of the total stream to −261° F. [−163° C.] (stream 74*b*). The flash expanded stream 74*b* then reenters heat exchanger 51 where it provides cooling to the feed gas (stream 72) and the refrigerant liquid (stream 74) as it is vaporized and superheated.

The superheated refrigerant vapor (stream 74*c*) leaves heat exchanger 51 at 110° F. [43° C.] and flows to refrigerant compressor 55, driven by a supplemental power source. Compressor 55 compresses the refrigerant to 145 psia [1,000 kPa(a)], whereupon the compressed stream 74*d* returns to partial condenser 56 to complete the cycle.

A summary of stream flow rates and energy consumption for the process illustrated in FIG. 2 is set forth in the following table:

TABLE II (FIG. 2)
Stream Flow Summary - Lb. Moles/Hr [kg moles/Hr]

| Stream | Methane | Ethane | Propane | Butanes+ | Total |
|---|---|---|---|---|---|
| 31 | 35,473 | 1,689 | 585 | 331 | 38,432 |
| 36 | 35,432 | 211 | 6 | 0 | 35,951 |
| 37 | 596 | 4 | 0 | 0 | 605 |
| 71 | 452 | 3 | 0 | 0 | 459 |
| 72 | 452 | 3 | 0 | 0 | 457 |
| 74 | 492 | 481 | 361 | 562 | 2,000 |
| 42 | 34,384 | 204 | 6 | 0 | 34,887 |
| 41 | 41 | 1,478 | 578 | 330 | 2,481 |
| 73 | 452 | 3 | 0 | 0 | 457 |
| Recoveries* | | | | | |
| Ethane | | | 87.52% | | |
| Propane | | | 98.92% | | |
| Butanes+ | | | 99.89% | | |
| LNG | | | 50,043 gallons/D<br>7,397 Lbs/H | [417.7 $m^3$/D]<br>[7,397 kg/H] | |
| LNG Purity | | | 98.94% | | |
| Power | | | | | |
| Residue Gas Compression | | | 14,484 HP | [23,811 kW] | |
| Refrigerant Compression | | | 2,282 HP | [3,752 kW] | |
| Total Gas Compression | | | 16,766 HP | [27,563 kW] | |

*(Based on un-rounded flow rates)

As stated earlier, the NGL recovery plant operates exactly the same in the FIG. 2 process as it does for the FIG. 1 process, so the recovery levels for ethane, propane, and butanes+ displayed in Table II are exactly the same as those displayed in Table I. The only significant difference is the amount of plant fuel gas (stream 37) used in the two processes. As can be seen by comparing Tables I and II, the plant fuel gas consumption is higher for the FIG. 2 process because of the additional power consumption of refrigerant compressor 55 (which is assumed to be driven by a gas engine or turbine). There is consequently a correspondingly lesser amount of gas entering residue gas compressor 19 (stream 38*a*), so the power consumption of this compressor is slightly less for the FIG. 2 process compared to the FIG. 1 process.

The net increase in compression power for the FIG. 2 process compared to the FIG. 1 process is 2,249 HP [3,697 kW], which is used to produce a nominal 50,000 gallons/D [417 $m^3$/D] of LNG. Since the density of LNG varies considerably depending on its storage conditions, it is more consistent to evaluate the power consumption per unit mass of LNG. The LNG production rate is 7,397 Lb/H [3,355 kg/H] in this case, so the specific power consumption for the FIG. 2 process is 0.304 HP-H/Lb [0.500 kW-H/kg].

For this adaptation of the prior art LNG production process where the NGL recovery plant residue gas is used as the source of feed gas for LNG production, no provisions have been included for removing heavier hydrocarbons from the LNG feed gas. Consequently, all of the heavier hydrocarbons present in the feed gas become part of the LNG product, reducing the purity (i.e. methane concentration) of the LNG product. If higher LNG purity is desired, or if the source of feed gas contains higher concentrations of heavier hydrocarbons (inlet gas stream 31, for instance), the feed stream 72 would need to be withdrawn from heat exchanger 51 after cooling to an intermediate temperature so that condensed liquid could be separated, with the uncondensed vapor thereafter returned to heat exchanger 51 for cooling to the final outlet temperature. These condensed liquids would preferentially contain the majority of the heavier hydrocarbons, along with a considerable fraction of liquid methane, which could then be re-vaporized and used to supply a part of the plant fuel gas requirements. Unfortunately, this means that the $C_2$ components, $C_3$ components, and heavier hydrocarbon components removed from the LNG feed stream would not be recovered in the NGL product from the NGL recovery plant, and their value as liquid products would be lost to the plant operator. Further, for feed streams such as the one considered in this example, condensation of liquid from the feed stream may not be possible due to the process operating conditions (i.e., operating at pressures above the cricondenbar of the stream), meaning that removal of heavier hydrocarbons could not be accomplished in such instances.

Figure 3:
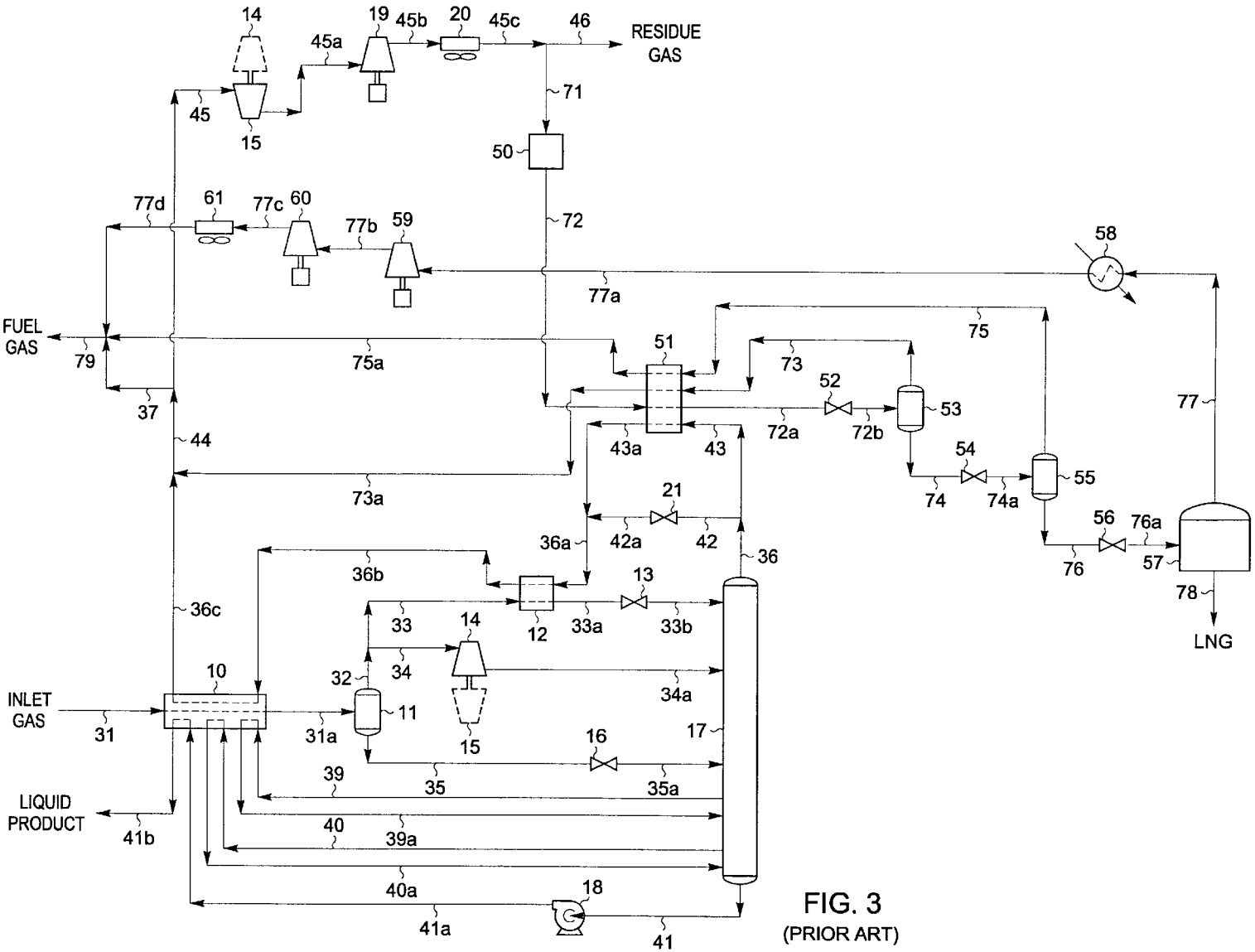
FIG. 3 (PRIOR ART)

The process of FIG. 2 is essentially a stand-alone LNG production facility that takes no advantage of the process streams or equipment in the NGL recovery plant. FIG. 3 shows another manner in which the NGL recovery plant in FIG. 1 can be adapted for co-production of LNG, in this case by application of the prior art process for LNG production according to U.S. Pat. No. 5,615,561, which integrates the LNG production process with the NGL recovery plant. The inlet gas composition and conditions considered in the process presented in FIG. 3 are the same as those in FIGS. 1 and 2.

In the simulation of the FIG. 3 process, the inlet gas cooling, separation, and expansion scheme for the NGL recovery plant is essentially the same as that used in FIG. 1. The main differences are in the disposition of the cold demethanizer overhead vapor (stream 36) and the compressed and cooled demethanizer overhead vapor (stream 45*c*) produced by the NGL recovery plant. Inlet gas enters the plant at 90° F. [32° C.] and 740 psia [5,102 kPa(a)] as stream 31 cooled in heat exchanger 10 by heat exchange with cool demethanizer overhead vapor at −69° F. [−56° C.] (stream 36*b*), bottom liquid product at 48° F. [9° C.] (stream 41*a*) from demethanizer bottoms pump 18, demethanizer reboiler liquids at 26° F. [−3° C.] (stream 40), and demethanizer side reboiler liquids at −50° F. [−46° C.] (stream 39). The cooled stream 31*a* enters separator 11 at −46° F. [−43° C.]and 725 psia [4,999 kPa(a)] where the vapor (stream 32) is separated from the condensed liquid (stream 35).

The vapor (stream 32) from separator 11 is divided into gaseous first and second streams, 33 and 34. Stream 33, containing about 25 percent of the total vapor passes through heat exchanger 12 in heat exchange relation with the cold demethanizer overhead vapor stream 36*a* where it is cooled to −142° F. [−97° C.]. The resulting substantially condensed stream 33*a* is then flash expanded through expansion valve 13 to the operating pressure (approximately 291 psia [2,006 kPa(a)]) of fractionation tower 17. During expansion a portion of the stream is vaporized, resulting in cooling of the total stream. In the process illustrated in FIG. 3, the expanded stream 33*b* leaving expansion valve 13 reaches a temperature of −158° F. [−105° C.] and is supplied to fractionation tower 17 as the top column feed. The vapor portion (if any) of stream 33*b* combines with the vapors rising from the top fractionation stage of the column to form demethanizer overhead vapor stream 36, which is withdrawn from an upper region of the tower.

Returning to the gaseous second stream 34, the remaining 75 percent of the vapor from separator 11 enters a work expansion machine 14 in which mechanical energy is extracted from this portion of the high pressure feed. The machine 14 expands the vapor substantially isentropically from a pressure of about 725 psia [4,999 kPa(a)] to the tower operating pressure, with the work expansion cooling the expanded stream 34*a* to a temperature of approximately −116° F. [−82° C.]. The expanded and partially condensed stream 34*a* is thereafter supplied as feed to fractionation tower 17 at an intermediate point. The separator liquid (stream 35) is likewise expanded to the tower operating pressure by expansion valve 16, cooling stream 35*a* to −80° F. [−62° C.] before it is supplied to fractionation tower 17 at a lower mid-column feed point.

The liquid product (stream 41) exits the bottom of tower 17 at 42° F. [6° C.]. This stream is pumped to approximately 650 psia [4,482 kPa(a)] (stream 41*a*) in pump 18 and warmed to 83° F. [28° C.] (stream 41*b*) in heat exchanger 10 as it provides cooling to stream 31. The distillation vapor stream forming the tower overhead (stream 36) leaves demethanizer 17 at −154° F. [−103° C.] and is divided into two portions. One portion (stream 43) is directed to heat exchanger 51 in the LNG production section to provide most of the cooling duty in this exchanger as it is warmed to −42° F. [−41 C.] (stream 43*a*). The remaining portion (stream 42) bypasses heat exchanger 51, with control valve 21 adjusting the quantity of this bypass in order to regulate the cooling accomplished in heat exchanger 51. The two portions recombine at −146° F. [−99° C.] to form stream 36*a*, which passes countercurrently to the incoming feed gas in heat exchanger 12 where it is heated to −69° F. [−56° C.] (stream 36*b*) and heat exchanger 10 where it is heated to 72° F. [22° C.] (stream 36*c*). Stream 36*c* combines with warm HP flash vapor (stream 73*a*) from the LNG production section, forming stream 44 at 72° F. [22° C.]. A portion of this stream is withdrawn (stream 37) to serve as part of the fuel gas for the plant. The remainder (stream 45) is re-compressed in two stages, compressor 15 driven by expansion machine 14 and compressor 19 driven by a supplemental power source, and cooled to 120° F. [49° C.] in discharge cooler 20. The cooled compressed stream (stream 45*c*) is then divided into two portions. One portion is the residue gas product (stream 46), which flows to the sales gas pipeline at 740 psia [5,102 kPa(a)]. The other portion (stream 71) is the feed stream for the LNG production section.

The inlet gas to the NGL recovery plant (stream 31) was not treated for carbon dioxide removal prior to processing. Although the carbon dioxide concentration in the inlet gas (about 0.5 mole percent) will not create any operating problems for the NGL recovery plant, a significant fraction of this carbon dioxide will leave the plant in the demethanizer overhead vapor (stream 36) and will subsequently contaminate the feed stream for the LNG production section (stream 71). The carbon dioxide concentration in this stream is about 0.4 mole percent, well in excess of the concentration that can be tolerated by this prior art process (0.005 mole percent). As for the FIG. 2 process, the feed stream 71 must be processed in carbon dioxide removal section 50 (which may also include dehydration of the treated gas stream) before entering the LNG production section to avoid operating problems due to carbon dioxide freezing.

The treated feed gas enters the LNG production section at 120° F. [49° C.] and 730 psia [5,033 kPa(a)] as stream 72 and is cooled in heat exchanger 51 by heat exchange with LP flash vapor at −200 F. [129° C.] (stream 75), HP flash vapor at −164° F. [−109° C.] (stream 73), and a portion of the demethanizer overhead vapor (stream 43) at −154° F. [−103° C.] from the NGL recovery plant. The purpose of heat exchanger 51 is to cool the feed stream to substantial condensation, and preferably to subcool the stream so as to reduce the quantity of flash vapor generated in subsequent expansion steps in the LNG cool-down section. For the conditions stated, however, the feed stream pressure is above the cricondenbar, so no liquid will condense as the stream is cooled. Instead, the cooled stream 72*a* leaves heat exchanger 51 at −148° F. [−100° C.] as a dense-phase fluid. At pressures below the cricondenbar, stream 72*a* would typically exit heat exchanger 51 as a condensed (and possibly subcooled) liquid stream.

Stream 72*a* is flash expanded substantially isenthalpically in expansion valve 52 from about 727 psia [5,012 kPa(a)] to the operating pressure of HP flash drum 53, about 279 psia [1,924 kPa(a)]. During expansion a portion of the stream is vaporized, resulting in cooling of the total stream to −164° F. [−109° C.] (stream 72*b*). The flash expanded stream 72*b* then enters HP flash drum 53 where the HP flash vapor (stream 73) is separated and directed to heat exchanger 51 as described previously. The operating pressure of the HP flash drum is set so that the heated HP flash vapor (stream 73*a*) leaving heat exchanger 51 is at sufficient pressure to allow it to join the heated demethanizer overhead vapor (stream 36*c*) leaving the NGL recovery plant and subsequently be compressed by compressors 15 and 19.

The HP flash liquid (stream 74) from HP flash drum 53 is flash expanded substantially isenthalpically in expansion valve 54 from the operating pressure of the HP flash drum to the operating pressure of LP flash drum 55, about 118 psia [814 kPa(a)]. During expansion a portion of the stream is vaporized, resulting in cooling of the total stream to −200° F. [−129° C.] (stream 74*a*). The flash expanded stream 74*a* then enters LP flash drum 55 where the LP flash vapor (stream 75) is separated and directed to heat exchanger 51 as described previously. The operating pressure of the LP flash drum is set so that the heated LP flash vapor (stream 75*a*) leaving heat exchanger 51 is at sufficient pressure to allow its use as plant fuel gas.

The LP flash liquid (stream 76) from LP flash drum 55 is flash expanded substantially isenthalpically in expansion valve 56 from the operating pressure of the LP flash drum to the LNG storage pressure (18 psia [124 kPa(a)]), slightly above atmospheric pressure. During expansion a portion of the stream is vaporized, resulting in cooling of the total stream to −254° F. [−159° C.] (stream 76*a*), whereupon it is then directed to LNG storage tank 57 where the flash vapor resulting from expansion (stream 77) is separated from the LNG product (stream 78).

The flash vapor (stream 77) from LNG storage tank 57 is at too low a pressure to be used for plant fuel gas, and is too cold to enter directly into a compressor. Accordingly, it is first heated to −30° F. [−34° C.] (stream 77*a*) in heater 58, then compressors 59 and 60 (driven by supplemental power sources) are used to compress the stream (stream 77*c*). Following cooling in aftercooler 61, stream 77*d* at 115 psia [793 kPa(a)] is combined with streams 37 and 75*a* to become the fuel gas for the plant (stream 79).

A summary of stream flow rates and energy consumption for the process illustrated in FIG. 3 is set forth in the following table:

TABLE III (FIG. 3)
Stream Flow Summary - Lb. Moles/Hr [kg moles/Hr]

| Stream | Methane | Ethane | Propane | Butanes+ | Total |
|---|---|---|---|---|---|
| 31 | 35,473 | 1,689 | 585 | 331 | 38,432 |
| 32 | 35,155 | 1,599 | 482 | 166 | 37,751 |
| 35 | 318 | 90 | 103 | 165 | 681 |
| 33 | 8,648 | 393 | 119 | 41 | 9,287 |
| 34 | 26,507 | 1,205 | 364 | 125 | 28,464 |
| 36 | 35,432 | 209 | 5 | 0 | 35,947 |
| 43 | 2,835 | 17 | 0 | 0 | 2,876 |
| 71 | 815 | 5 | 0 | 0 | 827 |
| 72 | 815 | 5 | 0 | 0 | 824 |
| 73 | 85 | 0 | 0 | 0 | 86 |
| 74 | 730 | 5 | 0 | 0 | 738 |
| 75 | 150 | 0 | 0 | 0 | 151 |
| 76 | 580 | 5 | 0 | 0 | 586 |
| 77 | 131 | 0 | 0 | 0 | 132 |
| 37 | 330 | 2 | 0 | 0 | 335 |
| 45 | 35,187 | 208 | 5 | 0 | 35,699 |
| 79 | 610 | 2 | 0 | 0 | 618 |
| 46 | 34,372 | 203 | 5 | 0 | 34,872 |
| 41 | 41 | 1,479 | 580 | 331 | 2,484 |
| 78 | 450 | 5 | 0 | 0 | 455 |

| Recoveries* | | |
|---|---|---|
| Ethane | 87.60% | |
| Propane | 99.12% | |
| Butanes+ | 99.92% | |
| LNG | 50,063 gallons/D | [417.8 $m^3$/D] |
| | 7,365 Lbs/H | [7,365 kg/H] |
| LNG Purity | 98.91% | |
| **Power** | | |
| Residue Gas Compression | 17,071 HP | [28,064 kW] |
| Flash Vapor Compression | 142 HP | [233 kW] |
| Total Gas Compression | 17,213 HP | [28,298 kW] |

*(Based on un-rounded flow rates)

The process of FIG. 3 uses a portion (stream 43) of the cold demethanizer overhead vapor (stream 36) to provide refrigeration to the LNG production process, which robs the NGL recovery plant of some of its refrigeration. Comparing the recovery levels displayed in Table III for the FIG. 3 process to those in Table II for the FIG. 2 process shows that the NGL recoveries have been maintained at essentially the same levels for both processes. However, this comes at the expense of increasing the utility consumption for the FIG. 3 process. Comparing the utility consumptions in Table III with those in Table II shows that the residue gas compression for the FIG. 3 process is nearly 18% higher than for the FIG. 2 process. Thus, the recovery levels could be maintained for the FIG. 3 process only by lowering the operating pressure of demethanizer 17, increasing the work expansion in machine 14 and thereby reducing the temperature of the demethanizer overhead vapor (stream 36) to compensate for the refrigeration lost to the NGL recovery plant in stream 43.

As can be seen by comparing Tables I and III, the plant fuel gas consumption is higher for the FIG. 3 process because of the additional power consumption of flash vapor compressors 59 and 60 (which are assumed to be driven by gas engines or turbines). There is consequently a correspondingly lesser amount of gas entering residue gas compressor 19 (stream 45*a*), but the power consumption of this compressor is still higher for the FIG. 3 process compared to the FIG. 1 process because of the higher compression ratio. The net increase in compression power for the FIG. 3 process compared to the FIG. 1 process is 2,696 HP [4,432 kW] to produce the nominal 50,000 gallons/D [417 $m^3$/D] of LNG. The specific power consumption for the FIG. 3 process is 0.366 HP-H/Lb [0.602 kW-H/kg], or about 20% higher than for the FIG. 2 process.

The FIG. 3 process has no provisions for removing heavier hydrocarbons from the feed gas to its LNG production section. Although some of the heavier hydrocarbons present in the feed gas leave in the flash vapor (streams 73 and 75) from separators 53 and 55, most of the heavier hydrocarbons become part of the LNG product and reduce its purity. The FIG. 3 process is incapable of increasing the LNG purity, and if a feed gas containing higher concentrations of heavier hydrocarbons (for instance, inlet gas stream 31, or even residue gas stream 45*c* when the NGL recovery plant is operating at reduced recovery levels) is used to supply the feed gas for the LNG production plant, the LNG purity would be even less than shown in this example.

DESCRIPTION OF THE INVENTION

EXAMPLE 1

Figure 4:
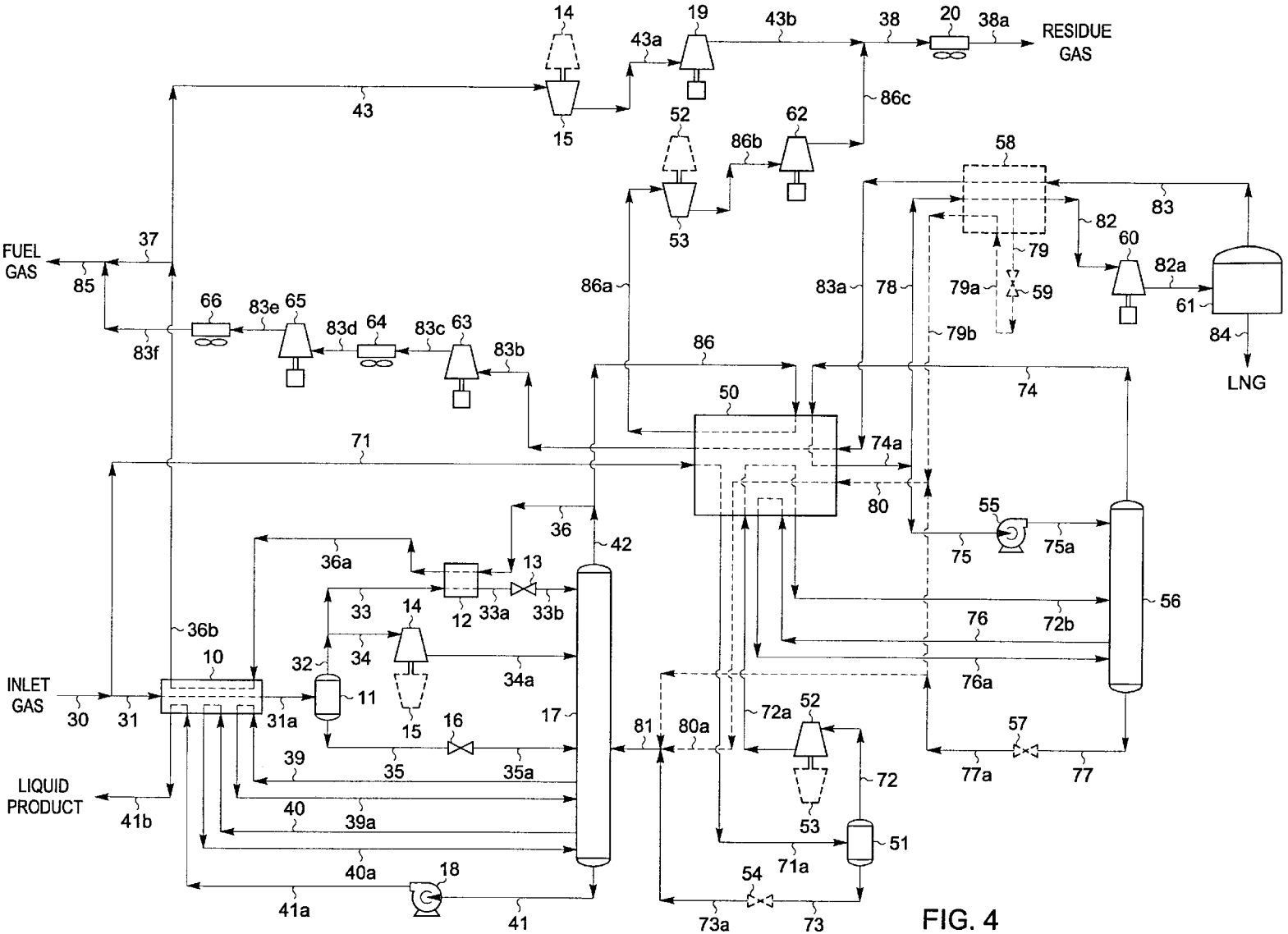
FIG. 4 is a flow diagram of said cryogenic natural gas processing plant when adapted for co-production of LNG in accordance with the present invention.

FIG. 4 illustrates a flow diagram of a process in accordance with the present invention. The inlet gas composition and conditions considered in the process presented in FIG. 4 are the same as those in FIGS. 1 through 3. Accordingly, the FIG. 4 process can be compared with that of the FIG. 2 and FIG. 3 processes to illustrate the advantages of the present invention.

In the simulation of the FIG. 4 process, the inlet gas cooling, separation, and expansion scheme for the NGL recovery plant is essentially the same as that used in FIG. 1. The main difference is that the inlet gas (stream 30) is divided into two portions, and only the first portion (stream 31) is supplied to the NGL recovery plant. The other portion (stream 71) is the feed gas for the LNG production section which employs the present invention.

Inlet gas enters the plant at 90° F. [32° C.] and 740 psia [5,102 kPa(a)] as stream 30. The feed gas for the LNG section is withdrawn (stream 71) and the remaining portion (stream 31) is cooled in heat exchanger 10 by heat exchange with cool distillation vapor at −66° F. [−54° C.] (stream 36*a*), bottom liquid product at 51° F. [10° C.] (stream 41*a*) from demethanizer bottoms pump 18, demethanizer reboiler liquids at 30° F. [−1° C.] (stream 40), and demethanizer side reboiler liquids at −39° F. [−39° C.] (stream 39). The cooled stream 31*a* enters separator 11 at −44° F. [−42° C.] and 725 psia [4,999 kPa(a)] where the vapor (stream 32) is separated from the condensed liquid (stream 35).

The vapor (stream 32) from separator 11 is divided into gaseous first and second streams, 33 and 34. Stream 33, containing about 26 percent of the total vapor passes through heat exchanger 12 in heat exchange relation with cold distillation vapor stream 36 where it is cooled to −148° F. [−100° C.]. The resulting substantially condensed stream 33*a* is then flash expanded through expansion valve 13 to the operating pressure (approximately 301 psia [2,075 kPa(a)]) of fractionation tower 17. During expansion a portion of the stream is vaporized, resulting in cooling of the total stream.

In the process illustrated in FIG. 4, the expanded stream 33*b* leaving expansion valve 13 reaches a temperature of −156° F. [−105° C.] and is supplied to fractionation tower 17 as the top column feed. The vapor portion (if any) of stream 33*b* combines with the vapors rising from the top fractionation stage of the column to form distillation vapor stream 42, which is withdrawn from an upper region of the tower.

Returning to the gaseous second stream 34, the remaining 74 percent of the vapor from separator 11 enters a work expansion machine 14 in which mechanical energy is extracted from this portion of the high pressure feed. The machine 14 expands the vapor substantially isentropically from a pressure of about 725 psia [4,999 kPa(a)] to the tower operating pressure, with the work expansion cooling the expanded stream 34*a* to a temperature of approximately −111° F. [−80° C.]. The expanded and partially condensed stream 34*a* is thereafter supplied as feed to fractionation tower 17 at an intermediate point. The separator liquid (stream 35) is likewise expanded to the tower operating pressure by expansion valve 16, cooling stream 35*a* to −75° F. [−59° C.] before it is supplied to fractionation tower 17 at a lower mid-column feed point.

The liquid product (stream 41) exits the bottom of tower 17 at 45° F. [7° C.]. This stream is pumped to approximately 650 psia [4,482 kPa(a)] (stream 41*a*) in pump 18 and warmed to 84° F. [29° C.] (stream 41*b*) in heat exchanger 10 as it provides cooling to stream 31. The distillation vapor stream forming the tower overhead at −152° F. [−102° C.] (stream 42) is divided into two portions. One portion (stream 86) is directed to the LNG production section. The remaining portion (stream 36) passes countercurrently to the incoming feed gas in heat exchanger 12 where it is heated to −66° F. [54° C.] (stream 36*a*) and in heat exchanger 10 where it is heated to 72° F. [22° C.] (stream 36*b*). A portion of the warmed distillation vapor stream is withdrawn (stream 37) to serve as part of the fuel gas for the plant, with the remainder becoming the first residue gas (stream 43). The first residue gas is then re-compressed in two stages, compressor 15 driven by expansion machine 14 and compressor 19 driven by a supplemental power source to form the compressed first residue gas (stream 43*b*).

Turning now to the LNG production section that employs the present invention, feed stream 71 enters heat exchanger 50 at 90° F. [32° C.] and 740 psia [5,102 kPa(a)]. Note that in all cases heat exchanger 50 is representative of either a multitude of individual heat exchangers or a single multipass heat exchanger, or any combination thereof. (The decision as to whether to use more than one heat exchanger for the indicated cooling services will depend on a number of factors including, but not limited to, feed stream flow rate, heat exchanger size, stream temperatures, etc.) In heat exchanger 50, the feed stream 71 is cooled by heat exchange with cool LNG flash vapor (stream 83*a*) and the distillation vapor stream from the NGL recovery plant (stream 86). The cooled stream 71*a* enters separator 51 at −36° F. [−38° C.] and 737 psia [5,081 kPa(a)] where the vapor (stream 72) is separated from the condensed liquid (stream 73).

The vapor (stream 72) from separator 51 enters a work expansion machine 52 in which mechanical energy is extracted from this portion of the high pressure feed. The machine 52 expands the vapor substantially isentropically from a pressure of about 737 psia [5,081 kPa(a)] to slightly above the operating pressure (440 psia [3,034 kPa(a)]) of distillation column 56 , with the work expansion cooling the expanded stream 72*a* to a temperature of approximately −79° F. [−62° C.]. The expanded and partially condensed stream 72*a* is directed to heat exchanger 50 and further cooled and condensed by heat exchange with cool LNG flash vapor (stream 83*a*) and the distillation vapor stream from the NGL recovery plant (stream 86) as described earlier, and by flash liquids (stream 80) and distillation column reboiler liquids at −135° F. [−93° C.] (stream 76). The condensed stream 72*b*, now at −135° F. [−93° C.], is thereafter supplied as feed to distillation column 56 at an intermediate point.

Distillation column 56 serves as an LNG purification tower. It is a conventional distillation column containing a plurality of vertically spaced trays, one or more packed beds, or some combination of trays and packing. This tower recovers nearly all of the hydrocarbons heavier than methane present in its feed stream (stream 72*b*) as its bottom product (stream 77) so that the only significant impurity in its overhead (stream 74) is the nitrogen contained in the feed stream. Equally important, this tower also captures in its bottom product nearly all of the carbon dioxide feeding the tower, so that carbon dioxide does not enter the downstream LNG cool-down section where the extremely low temperatures would cause the formation of solid carbon dioxide, creating operating problems. The lower section of LNG purification tower 56 includes a reboiler which heats and vaporizes a portion of the liquids flowing down the column (by cooling stream 72*a* in heat exchanger 50 as described earlier) to provide stripping vapors which flow up the column to strip some of the methane from the liquids. This reduces the amount of methane in the bottom product from the tower (stream 77) so that less methane must be rejected by fractionation tower 17 when this stream is supplied to it (as described later).

Reflux for distillation column 56 is created by cooling and condensing the tower overhead vapor (stream 74 at −142° F. [−96° C.]) in heat exchanger 50 by heat exchange with cool LNG flash vapor at −147° F. [−99° C.] (stream 83*a*) and flash liquids at −152° F. [−102° C.] (stream 80). The condensed stream 74*a*, now at −144° F. [−98° C.], is divided into two portions. One portion (stream 78) becomes the feed to the LNG cool-down section. The other portion (stream 75) enters reflux pump 55. After pumping, stream 75*a* at −143° F. [−97° C.] is supplied to LNG purification tower 56 at a top feed point to provide the reflux liquid for the tower. This reflux liquid rectifies the vapors rising up the tower so that the tower overhead vapor (stream 74) and consequently feed stream 78 to the LNG cool-down section contain minimal amounts of carbon dioxide and hydrocarbons heavier than methane. The amount of reboiling in the bottom of the column is adjusted as necessary to generate sufficient overhead vapor from the column, so that there is enough reflux liquid from heat exchanger 50 to provide the desired rectification in the tower.

The feed stream for the LNG cool-down section (condensed liquid stream 78) enters heat exchanger 58 at −144° F. [−98° C.] and is subcooled by heat exchange with cold LNG flash vapor at −255° F. [−160° C.] (stream 83) and cold flash liquids (stream 79*a*). The cold flash liquids are produced by withdrawing a portion of the partially subcooled feed stream (stream 79) from heat exchanger 58 and flash expanding the stream through an appropriate expansion device, such as expansion valve 59, to slightly above the operating pressure of fractionation tower 17. During expansion a portion of the stream is vaporized, resulting in cooling of the total stream from −157° F. [−105° C.] to −161° F. [−107° C.] (stream 79*a*). The flash expanded stream 79*a* is then supplied to heat exchanger 58 as previously described.

The remaining portion of the partially subcooled feed stream is further subcooled in heat exchanger 58 to −170° F.

[−112° C.] (stream 82). It then enters a work expansion machine 60 which mechanical energy is extracted from this intermediate pressure stream. The machine 60 expands the subcooled liquid substantially isentropically from a pressure of about 434 psia [2,992 kPa(a)] to the LNG storage pressure (18 psia [124 kPa(a)]), slightly above atmospheric pressure. The work expansion cools the expanded stream 82 a to a temperature of approximately −255° F. [−160° C.], whereupon it is then directed to LNG storage tank 61 where the flash vapor resulting from expansion (stream 83) is separated from the LNG product (stream 84).

Tower bottoms stream 77 from LNG purification tower 56 is flash expanded to slightly above the operating pressure of fractionation tower 17 by expansion valve 57. During expansion a portion of the stream is vaporized, resulting in cooling of the total stream from −133° F. [−92° C.] to −152° F. [−102° C.] (stream 77*a*). The flash expanded stream 77 a is then combined with warmed flash liquid stream 79*b* leaving heat exchanger 58 at −147° F. [−99° C.] to form a combined flash liquid stream (stream 80) at −152° F.[−102° C.] which is supplied to heat exchanger 50. It is heated to −88° F. [−67° C.] (stream 80*a*) as it supplies cooling to expanded stream 72*a* and tower overhead vapor stream 74 as described earlier.

The separator liquid (stream 73) is flash expanded to the operating pressure of fractionation tower 17 by expansion valve 54, cooling stream 73*a* to −65° F. [−54° C.]. The expanded stream 73*a* is combined with heated flash liquid stream 80*a* to form stream 81, which is supplied to fractionation tower 17 at a lower mid-column feed point. If desired, stream 81 can be combined with flash expanded stream 35*a* described earlier and the combined stream supplied to a single lower mid-column feed point on the tower.

The flash vapor (stream 83) from LNG storage tank 61 passes countercurrently to the incoming liquid in heat exchanger 58 where it is heated to −147° F. [−99° C.] (stream 83*a*). It then enters heat exchanger 50 where it is heated to 87° F. [31° C.] (stream 83*b*) as it supplies cooling to feed stream 71, expanded stream 72*a*, and tower overhead stream 74. Since this stream is at low pressure (15.5 psia [107 kPa(a)]), it must be compressed before it can be used as plant fuel gas. Compressors 63 and 65 (driven by supplemental power sources) with intercooler 64 are used to compress the stream (stream 83*e*). Following cooling in aftercooler 66, stream 83*f* at 115 psia [793 kPa(a)] is combined with stream 37 to become the fuel gas for the plant (stream 85).

The cold distillation vapor stream from the NGL recovery plant (stream 86) is heated to 86° F. [30° C.] as it supplies cooling to feed stream 71 and expanded stream 72*a* in heat exchanger 50, becoming the second residue gas (stream 86*a*). The second residue gas is then re-compressed in two stages, compressor 53 driven by expansion machine 52 and compressor 62 driven by a supplemental power source. The compressed second residue gas (stream 86*c*) combines with the compressed first residue gas (stream 43*b*) to form residue gas stream 38 . After cooling to 120° F. [49° C.] in discharge cooler 20, the residue gas product (stream 38*a*) flows to the sales gas pipeline at 740 psia [5,102 kPa(a)].

A summary of stream flow rates and energy consumption for the process illustrated in FIG. 4 is set forth in the following table:

TABLE IV (FIG. 4)
Stream Flow Summary - Lb. Moles/Hr [kg moles/Hr]

| Stream | Methane | Ethane | Propane | Butanes+ | Total |
|---|---|---|---|---|---|
| 30 | 35,473 | 1,689 | 585 | 331 | 38,432 |
| 31 | 32,760 | 1,560 | 540 | 306 | 35,492 |
| 32 | 32,508 | 1,488 | 457 | 164 | 34,940 |
| 35 | 252 | 72 | 83 | 141 | 552 |
| 33 | 8,550 | 391 | 120 | 43 | 9,189 |
| 34 | 23,959 | 1,097 | 337 | 121 | 25,751 |
| 42 | 34,767 | 212 | 5 | 0 | 35,276 |
| 36 | 32,254 | 196 | 5 | 0 | 32,726 |
| 37 | 358 | 2 | 0 | 0 | 363 |
| 71 | 2,714 | 129 | 45 | 25 | 2,940 |
| 72 | 2,701 | 125 | 40 | 16 | 2,909 |
| 73 | 13 | 4 | 4 | 9 | 31 |
| 74 | 1,239 | 0 | 0 | 0 | 1,258 |
| 77 | 1,945 | 125 | 40 | 16 | 2,142 |
| 75 | 483 | 0 | 0 | 0 | 491 |
| 78 | 756 | 0 | 0 | 0 | 767 |
| 79 | 91 | 0 | 0 | 0 | 92 |
| 83 | 211 | 0 | 0 | 0 | 220 |
| 85 | 569 | 2 | 0 | 0 | 583 |
| 86 | 2,513 | 15 | 0 | 0 | 2,550 |
| 38 | 34,409 | 209 | 5 | 0 | 34,913 |
| 41 | 41 | 1,477 | 579 | 331 | 2,481 |
| 84 | 455 | 0 | 0 | 0 | 456 |

| Recoveries* | | |
|---|---|---|
| Ethane | 87.47% | |
| Propane | 99.09% | |
| Butanes+ | 99.91% | |
| LNG | 50,034 gallons/D | [417.6 $m^3$/D] |
| | 7,333 Lbs/H | [7,333 kg/H] |
| LNG Purity | 99.77% | |

| Power | | |
|---|---|---|
| 1st Residue Gas Compression | 14,529 HP | [23,885 kW] |
| 2nd Residue Gas Compression | 1,197 HP | [1,968 kW] |
| Flash Vapor Compression | 289 HP | [475 kW] |
| Total Gas Compression | 16,015 HP | [26,328 kW] |

*(Based on un-rounded flow rates)

Comparing the recovery levels displayed in Table IV for the FIG. 4 process to those in Table I for the FIG. 1 process shows that the recoveries in the NGL recovery plant have been maintained at essentially the same levels for both processes. Comparison of the utility consumptions displayed in Table IV for the FIG. 4 process with those in Table I for the FIG. 1 process shows that the residue gas compression required for the NGL recovery plant is essentially the same for both processes. This indicates that there is no loss in recovery efficiency despite using a portion (stream 86) of the cold distillation vapor stream (stream 42) from the NGL recovery plant to provide refrigeration to the LNG production section. Thus, unlike the FIG. 3 process, integrating the LNG production process of the present invention with the NGL recovery plant can be accomplished without adverse impact on NGL recovery efficiency.

The net increase in compression power for the FIG. 4 process compared to the FIG. 1 process is 1,498 HP [2,463 kW] to produce the nominal 50,000 gallons/D [417 $m^3$/D] of LNG, giving a specific power consumption of 0.204 HP-H/Lb [0.336 kW-H/kg] for the FIG. 4 process. Thus, the present invention has a specific power consumption that is only 67% of the FIG. 2 prior art process and only 56% of the FIG. 3 prior art process. Further, the present invention does not require carbon dioxide removal from the feed gas prior to entering the LNG production section like the prior art processes do, eliminating the capital cost and operating cost associated with constructing and operating the gas treatment processes required for the FIG. 2 and FIG. 3 processes.

Not only is the present invention more efficient than either prior art process, the LNG it produces is of higher purity due to the inclusion of LNG purification tower 56. This higher LNG purity is even more noteworthy considering that the source of the feed gas used for this example (inlet gas, stream 30) contains much higher concentrations of heavier hydrocarbons than the feed gas used in the FIG. 2 and FIG. 3 processes (i.e., the NGL recovery plant residue gas). The purity of the LNG is in fact limited only by the concentration of gases more volatile than methane (nitrogen, for instance) present in feed stream 71, as the operating parameters of purification tower 56 can be adjusted as needed to keep the concentration of heavier hydrocarbons in the LNG product as low as desired.

EXAMPLE 2

Figure 5:
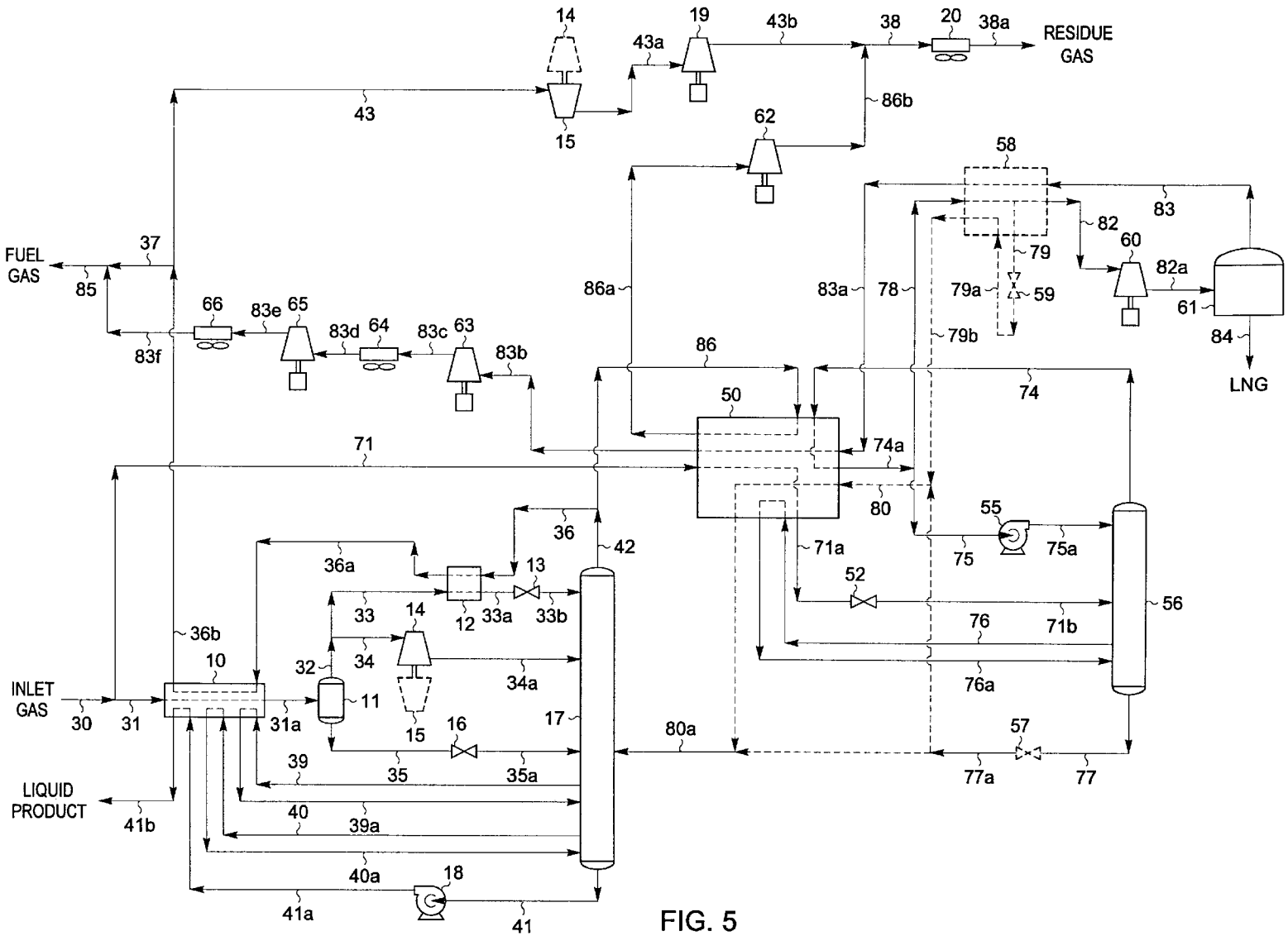
FIG. 5 is a flow diagram illustrating an alternative means of application of the present invention for co-production of LNG from said cryogenic natural gas processing plant.

FIG. 4 represents the preferred embodiment of the present invention for the temperature and pressure conditions shown because it typically provides the most efficient LNG production. A slightly less complex design that maintains the same LNG production with somewhat higher utility consumption can be achieved using another embodiment of the present invention as illustrated in the FIG. 5 process. The inlet gas composition and conditions considered in the process presented in FIG. 5 are the same as those in FIGS. 1 through 4. Accordingly, the FIG. 5 process can be compared with that of the FIG. 2 and FIG. 3 processes to illustrate the advantages of the present invention, and can likewise be compared to the embodiment displayed in FIG. 4.

In the simulation of the FIG. 5 process, the inlet gas cooling, separation, and expansion scheme for the NGL recovery plant is essentially the same as that used in FIG. 4. Inlet gas enters the plant at 90° F. [32° C.] and 740 psia [5,102 kPa(a)] as stream 30. The feed gas for the LNG section is withdrawn (stream 71) and the remaining portion (stream 31) is cooled in heat exchanger 10 by heat exchange with cool distillation vapor at −65° F. [−54° C.] (stream 36*a*), bottom liquid product at 50° F. [10° C.] (stream 41*a*) from demethanizer bottoms pump 18, demethanizer reboiler liquids at 29° F. [−2° C.] (stream 40), and demethanizer side reboiler liquids at −41° F. [−40° C.] (stream 39). The cooled stream 31*a* enters separator 11 at −43° F. [−42° C.] and 725 psia [4,999 kPa(a)] where the vapor (stream 32) is separated from the condensed liquid (stream 35).

The vapor (stream 32) from separator 11 is divided into gaseous first and second streams, 33 and 34. Stream 33, containing about 26 percent of the total vapor passes through heat exchanger 12 in heat exchange relation with the cold distillation vapor stream 36 where it is cooled to −148° F. [−100° C.]. The resulting substantially condensed stream 33*a* is then flash expanded through expansion valve 13 to the operating pressure (approximately 296 psia [2,041 kPa(a)]) of fractionation tower 17. During expansion a portion of the stream is vaporized, resulting in cooling of the total stream. In the process illustrated in FIG. 5, the expanded stream 33*b* leaving expansion valve 13 reaches a temperature of −157F [−105° C.] and is supplied to fractionation tower 17 as the top column feed. The vapor portion (if any) of stream 33*b* combines with the vapors rising from the top fractionation stage of the column to form distillation vapor stream 42, which is withdrawn from an upper region of the tower.

Returning to the gaseous second stream 34, the remaining 74 percent of the vapor from separator 11 enters a work expansion machine 14 in which mechanical energy is extracted from this portion of the high pressure feed. The machine 14 expands the vapor substantially isentropically from a pressure of about 725 psia [4,999 kPa(a)] to the tower operating pressure, with the work expansion cooling the expanded stream 34*a* to a temperature of approximately −112° F. [−80° C.]. The expanded and partially condensed stream 34*a* is thereafter supplied as feed to fractionation tower 17 at an intermediate point. The separator liquid (stream 35) is likewise expanded to the tower operating pressure by expansion valve 16, cooling stream 35*a* to −75°F. [−59° C.] before it is supplied to fractionation tower 17 at a lower mid-column feed point.

The liquid product (stream 41) exits the bottom of tower 17 at 44° F. [7° C.]. This stream is pumped to approximately 650 psia [4,482 kPa(a)] (stream 41*a*) in pump 18 and warmed to 83° F. [28° C.] (stream 41*b*) in heat exchanger 10 as it provides cooling to stream 31. The distillation vapor stream forming the tower overhead at −153° F. [−103° C.] (stream 42) is divided into two portions. One portion (stream 86) is directed to the LNG production section. The remaining portion (stream 36) passes countercurrently to the incoming feed gas in heat exchanger 12 where it is heated to −65° F. [54° C.] (stream 36*a*) and heat exchanger 10 where it is heated to 73° F. [23° C.] (stream 36*b*). A portion of the warmed distillation vapor stream is withdrawn (stream 37) to serve as part of the fuel gas for the plant, with the remainder becoming the first residue gas (stream 43). The first residue gas is then re-compressed in two stages, compressor 15 driven by expansion machine 14 and compressor 19 driven by a supplemental power source to form the compressed first residue gas (stream 43*b*).

Turning now to the LNG production section that employs an alternative embodiment of the present invention, feed stream 71 enters heat exchanger 50 at 90° F. [32° C.] and 740 psia [5,102 kPa(a)]. The feed stream 71 is cooled to −120° F. [−84° C.] in heat exchanger 50 by heat exchange with cool LNG flash vapor (stream 83*a*), the distillation vapor stream from the NGL recovery plant at −153° F. [−103° C.] (stream 86), flash liquids (stream 80), and distillation column reboiler liquids at −134° F. [−92° C.] (stream 76). The resulting substantially condensed stream 71*a* is then flash expanded through an appropriate expansion device, such as expansion valve 52, to the operating pressure (440 psia [3,034 kPa(a)]) of distillation column 56. During expansion a portion of the stream is vaporized, resulting in cooling of the total stream. In the process illustrated in FIG. 5, the expanded stream 71*b* leaving expansion valve 52 reaches a temperature of −134° F. [−92° C.] and is thereafter supplied as feed to distillation column 56 at an intermediate point.

As in the FIG. 4 embodiment of the present invention, distillation column 56 serves as an LNG purification tower, recovering nearly all of the carbon dioxide and the hydrocarbons heavier than methane present in its feed stream (stream 71*b*) as its bottom product (stream 77) so that the only significant impurity in its overhead (stream 74) is the nitrogen contained in the feed stream. Reflux for distillation column 56 is created by cooling and condensing the tower overhead vapor (stream 74 at −141° F. [−96° C.]) in heat exchanger 50 by heat exchange with cool LNG flash vapor at −146° F. [−99° C.] (stream 83*a*) and flash liquids at −152° F. [−102° C.] (stream 80). The condensed stream 74*a*, now at −144° F. [−98° C.], is divided into two portions. One portion (stream 78) becomes the feed to the LNG cool-down section. The other portion (stream 75) enters reflux pump 55. After pumping, stream 75*a* at −143° F. [−97° C.] is supplied to LNG purification tower 56 at a top feed point to provide the reflux liquid for the tower. This reflux liquid rectifies the vapors rising up the tower so that the tower overhead (stream 74) and consequently feed stream 78 to the LNG cool-down section contain minimal amounts of carbon dioxide and hydrocarbons heavier than methane.

The feed stream for the LNG cool-down section (condensed liquid stream 78) enters heat exchanger 58 at −144° F. [−98° C.] and is subcooled by heat exchange with cold LNG flash vapor at −255° F. [−160° C.] (stream 83) and cold flash liquids (stream 79*a*). The cold flash liquids are produced by withdrawing a portion of the partially subcooled feed stream (stream 79) from heat exchanger 58 and flash expanding the stream through an appropriate expansion device, such as expansion valve 59, to slightly above the operating pressure of fractionation tower 17. During expansion a portion of the stream is vaporized, resulting in cooling of the total stream from −157° F. [−105° C.] to −162° F. [−108° C.] (stream 79*a*). The flash expanded stream 79*a* is then supplied to heat exchanger 58 as previously described.

The remaining portion of the partially subcooled feed stream is further subcooled in heat exchanger 58 to −170° F. [−112° C.] (stream 82). It then enters a work expansion machine 60 in which mechanical energy is extracted from this intermediate pressure stream. The machine 60 expands the subcooled liquid substantially isentropically from a pressure of about 434 psia [2,992 kPa(a)] to the LNG storage pressure (18 psia [124 kPa(a)]), slightly above atmospheric pressure. The work expansion cools the expanded stream 82*a* to a temperature of approximately −255° F. [−160° C.], whereupon it is then directed to LNG storage tank 61 where the flash vapor resulting from expansion (stream 83) is separated from the LNG product (stream 84).

Tower bottoms stream 77 from LNG purification tower 56 is flash expanded to slightly above the operating pressure of fractionation tower 17 by expansion valve 57. During expansion a portion of the stream is vaporized, resulting in cooling of the total stream from −133° F. [−91° C.] to −152° F. [−102° C.] (stream 77*a*). The flash expanded stream 77*a* is then combined with warmed flash liquid stream 79*b* leaving heat exchanger 58 at −146° F. [−99° C.] to form a combined flash liquid stream (stream 80) at −152° F. [−102° C.] which is supplied to heat exchanger 50. It is heated to −87° F. [−66° C.] (stream 80*a*) as it supplies cooling to feed stream 71 and tower overhead vapor stream 74 as described earlier, and thereafter supplied to fractionation tower 17 at a lower mid-column feed point. If desired, stream 80*a* can be combined with flash expanded stream 35*a* described earlier and the combined stream supplied to a single lower mid-column feed point on the tower.

The flash vapor (stream 83) from LNG storage tank 61 passes countercurrently to the incoming liquid in heat exchanger 58 where it is heated to −146° F. [−99° C.] (stream 83*a*). It then enters heat exchanger 50 where it is heated to 87° F. [31° C.] (stream 83*b*) as it supplies cooling to feed stream 71 and tower overhead stream 74. Since this stream is at low pressure (15.5 psia [107 kPa(a)]), it must be compressed before it can be used as plant fuel gas. Compressors 63 and 65 (driven by supplemental power sources) with intercooler 64 are used to compress the stream (stream 83*e*). Following cooling in aftercooler 66, stream 83*f* at 115 psia [793 kPa(a)] is combined with stream 37 to become the fuel gas for the plant (stream 85).

The cold distillation vapor stream from the NGL recovery plant (stream 86) is heated to 87° F. [31° C.] as it supplies cooling to feed stream 71 in heat exchanger 50, becoming the second residue gas (stream 86*a*) which is then re-compressed in compressor 62 driven by a supplemental power source. The compressed second residue gas (stream 86*b*) combines with the compressed first residue gas (stream 43*b*) to form residue gas stream 38 . After cooling to 120° F. [49° C.] in discharge cooler 20, the residue gas product (stream 38*a*) flows to the sales gas pipeline at 740 psia [5,102 kPa(a)].

A summary of stream flow rates and energy consumption for the process illustrated in FIG. 5 is set forth in the following table:

TABLE V (FIG. 5)
Stream Flow Summary - Lb. Moles/Hr [kg moles/Hr]

| Stream | Methane | Ethane | Propane | Butanes+ | Total |
|---|---|---|---|---|---|
| 30 | 35,473 | 1,689 | 585 | 331 | 38,432 |
| 31 | 32,701 | 1,557 | 539 | 305 | 35,428 |
| 32 | 32,459 | 1,488 | 459 | 166 | 34,894 |
| 35 | 242 | 69 | 80 | 139 | 533 |
| 33 | 8,537 | 391 | 121 | 44 | 9,177 |
| 34 | 23,922 | 1,097 | 338 | 123 | 25,717 |
| 42 | 34,766 | 211 | 5 | 0 | 35,275 |
| 36 | 31,918 | 193 | 5 | 0 | 32,385 |
| 37 | 376 | 2 | 0 | 0 | 381 |
| 71 | 2,773 | 132 | 46 | 26 | 3,004 |
| 74 | 1,240 | 0 | 0 | 0 | 1,258 |
| 77 | 2,016 | 132 | 46 | 26 | 2,237 |
| 75 | 484 | 0 | 0 | 0 | 491 |
| 78 | 757 | 0 | 0 | 0 | 767 |
| 79 | 91 | 0 | 0 | 0 | 92 |
| 83 | 211 | 0 | 0 | 0 | 219 |
| 85 | 586 | 2 | 0 | 0 | 600 |
| 86 | 2,848 | 17 | 0 | 0 | 2,890 |
| 38 | 34,391 | 208 | 5 | 0 | 34,894 |
| 41 | 41 | 1,478 | 580 | 331 | 2,481 |
| 84 | 455 | 0 | 0 | 0 | 456 |

| Recoveries* | | |
|---|---|---|
| Ethane | 87.53% | |
| Propane | 99.11% | |
| Butanes+ | 99.91% | |
| LNG | 50,041 gallons/D | [417.6 $m^3$/D] |
| | 7,334 Lbs/H | [7,334 kg/H] |
| LNG Purity | 99.78% | |
| Power | | |
| 1st Residue Gas Compression | 14,664 HP | [24,107 kW] |
| 2nd Residue Gas Compression | 1,661 HP | [2,731 kW] |
| Flash Vapor Compression | 289 HP | [475 kW] |
| Total Gas Compression | 16,614 HP | [27,313 kW] |

*(Based on un-rounded flow rates)

As can be seen by comparing the recovery levels and utility consumptions displayed in Table V for the FIG. 5 process with those in Table I and Table IV for the FIG. 1 and FIG. 4 processes, respectively, the recovery efficiency of the NGL recovery plant is undiminished when integrated with this embodiment of the present invention for co-production of LNG. The LNG production efficiency of this embodiment is not as high as for the preferred embodiment shown in FIG. 4 due to the higher utility consumption of second residue gas compressor 62 that results from eliminating the work expansion machine 52 that was used to drive compressor 53 in the FIG. 4 embodiment. The net increase in compression power for the FIG. 5 process compared to the FIG. 1 process is 2,097 HP [3,447 kW] to produce the nominal 50,000 gallons/D [417 $m^3$/D] of LNG, giving a specific power consumption of 0.286 HP-H/Lb [0.470 kW-H/kg] for the FIG. 5 process. Although this is about 40% higher than the preferred embodiment shown in FIG. 4, it is still lower than either of the prior art processes displayed in FIGS. 2 and 3. Further, as for the FIG. 4 embodiment, the LNG purity is higher than for either prior art process, and carbon dioxide removal from the feed gas to the LNG production section is not required.

The choice between the FIG. 4 embodiment and the FIG. 5 embodiment of the present invention depends on the relative value of the simpler arrangement and lower capital cost of the FIG. 5 embodiment versus the lower utility consumption of the FIG. 4 embodiment. The decision of which embodiment of the present invention to use in a particular circumstance will often depend on factors such as plant size, available equipment, and the economic balance of capital cost versus operating cost.

EXAMPLE 3

Figure 6:
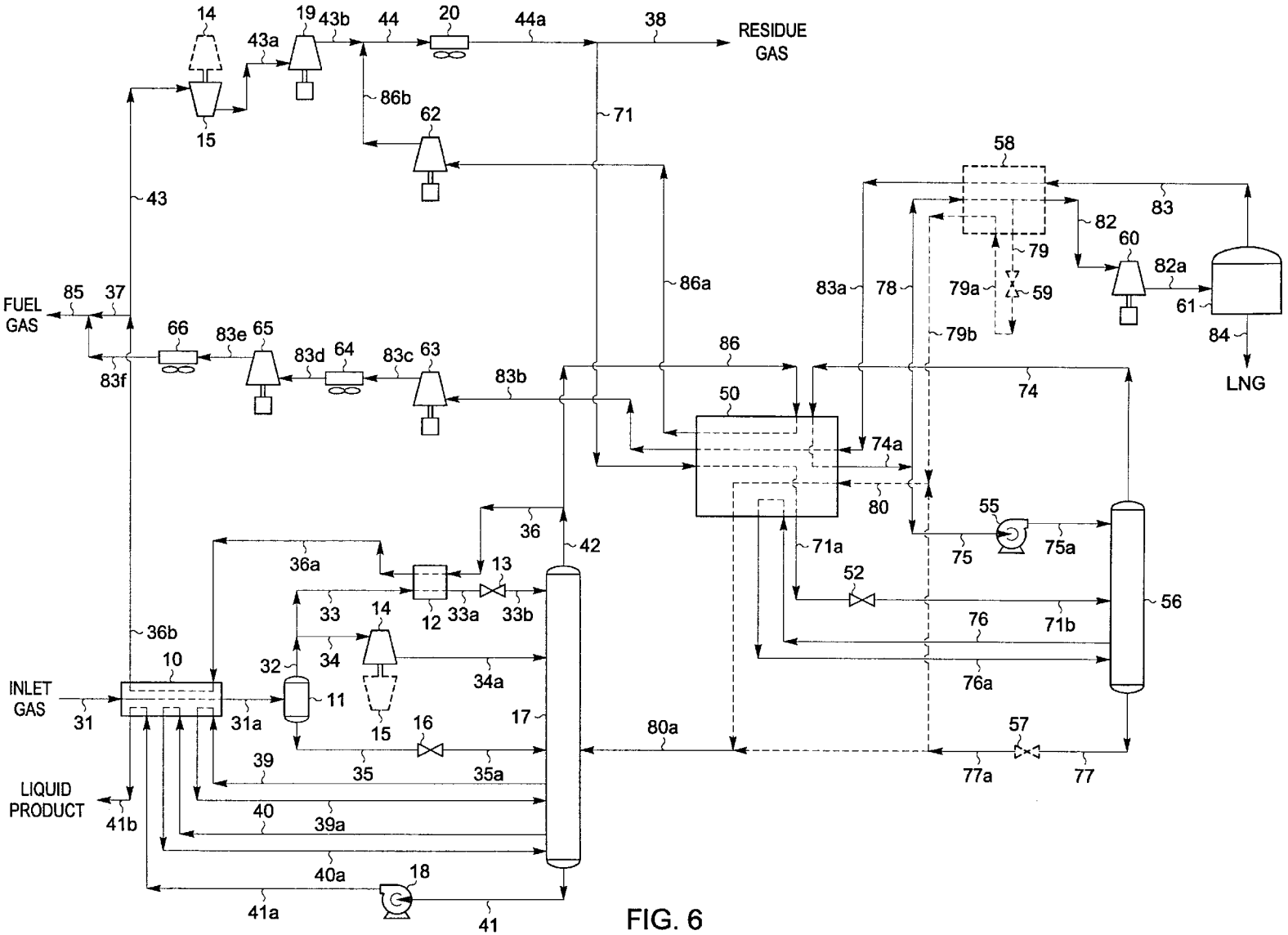
FIG. 6 is a flow diagram illustrating an alternative means of application of the present invention for co-production of LNG from said cryogenic natural gas processing plant.

In FIGS. 4 and 5, a portion of the plant inlet gas is processed using the present invention to co-produce LNG. Alternatively, the present invention can instead be adapted to process a portion of the plant residue gas to co-produce LNG as illustrated in FIG. 6. The inlet gas composition and conditions considered in the process presented in FIG. 6 are the same as those in FIGS. 1 through 5. Accordingly, the FIG. 6 process can be compared with that of the FIG. 2 and FIG. 3 processes to illustrate the advantages of the present invention, and can likewise be compared to the embodiments displayed in FIGS. 4 and 5.

In the simulation of the FIG. 6 process, the inlet gas cooling, separation, and expansion scheme for the NGL recovery plant is essentially the same as that used in FIG. 1. The main differences are in the disposition of the cold distillation stream (stream 42) and the compressed and cooled third residue gas (stream 44*a*) produced by the NGL recovery plant. Note that the third residue gas (stream 44*a*) is divided into two portions, and only the first portion (stream 38) becomes the residue gas product from the NGL recovery plant that flows to the sales gas pipeline. The other portion (stream 71) is the feed gas for the LNG production section which employs the present invention.

Inlet gas enters the plant at 90° F. [32° C.] and 740 psia [5,102 kPa(a)] as stream 31 and is cooled in heat exchanger 10 by heat exchange with cool distillation vapor stream 36*a* at −66° F. [−55° C.], bottom liquid product at 52° F. [11° C.] (stream 41*a*) from demethanizer bottoms pump 18, demethanizer reboiler liquids at 31° F. [0° C.] (stream 40), and demethanizer side reboiler liquids at −42° F. [−41° C.] (stream 39). The cooled stream 31*a* enters separator 11 at −44° F. [−42° C.] and 725 psia [4,999 kPa(a)] where the vapor (stream 32) is separated from the condensed liquid (stream 35).

The vapor (stream 32) from separator 11 is divided into gaseous first and second streams, 33 and 34. Stream 33, containing about 26 percent of the total vapor passes through heat exchanger 12 in heat exchange relation with the cold distillation vapor stream 36 where it is cooled to −146° F. [−99° C.]. The resulting substantially condensed stream 33*a* is then flash expanded through expansion valve 13 to the operating pressure (approximately 306 psia [2,110 kPa(a)]) of fractionation tower 17. During expansion a portion of the stream is vaporized, resulting in cooling of the total stream. In the process illustrated in FIG. 6, the expanded stream 33*b* leaving expansion valve 13 reaches a temperature of −155° F. [−104° C.] and is supplied to fractionation tower 17 as the top column feed. The vapor portion (if any) of stream 33*b* combines with the vapors rising from the top fractionation stage of the column to form distillation vapor stream 42, which is withdrawn from an upper region of the tower.

Returning to the gaseous second stream 34, the remaining 74 percent of the vapor from separator 11 enters a work expansion machine 14 in which mechanical energy is extracted from this portion of the high pressure feed. The machine 14 expands the vapor substantially isentropically from a pressure of about 725 psia [4,999 kPa(a)] to the tower operating pressure, with the work expansion cooling the expanded stream 34*a* to a temperature of approximately −110° F. [−79° C.]. The expanded and partially condensed stream 34*a* is thereafter supplied as feed to fractionation tower 17 at an intermediate point. The separator liquid (stream 35) is likewise expanded to the tower operating pressure by expansion valve 16, cooling stream 35*a* to −75° F. [−59° C.] before it is supplied to fractionation tower 17 at a lower mid-column feed point.

The liquid product (stream 41) exits the bottom of tower 17 at 47° F. [8° C.]. This stream is pumped to approximately 650 psia [4,482 kPa(a)] (stream 41*a*) in pump 18 and warmed to 83° F. [28° C.] (stream 41*b*) in heat exchanger 10 as it provides cooling to stream 31. The distillation vapor stream forming the tower overhead at −151° F. [−102° C.] (stream 42) is divided into two portions. One portion (stream 86) is directed to the LNG production section. The remaining portion (stream 36) passes countercurrently to the incoming feed gas in heat exchanger 12 where it is heated to −66° F. [−55° C.] (stream 36*a*) and heat exchanger 10 where it is heated to 72° F. [22° C.] (stream 36*b*). A portion of the warmed distillation vapor stream is withdrawn (stream 37) to serve as part of the fuel gas for the plant, with the remainder becoming the first residue gas (stream 43). The first residue gas is then re-compressed in two stages, compressor 15 driven by expansion machine 14 and compressor 19 driven by a supplemental power source to form the compressed first residue gas (stream 43*b*).

Turning now to the LNG production section that employs an alternative embodiment of the present invention, feed stream 71 enters heat exchanger 50 at 120° F. [49° C.] and 740 psia [5,102 kPa(a)]. The feed stream 71 is cooled to −120° F. [−84° C.] in heat exchanger 50 by heat exchange with cool LNG flash vapor (stream 83*a*), the distillation vapor stream from the NGL recovery plant at −151° F. [−102° C.] (stream 86), flash liquids (stream 80), and distillation column reboiler liquids at −142° F. [−97° C.] (stream 76). (For the conditions stated, the feed stream pressure is above the cricondenbar, so no liquid will condense as the stream is cooled. Instead, the cooled stream 71*a* leaves heat exchanger 50 as a dense-phase fluid. For other processing conditions, it is possible that the feed gas pressure will be below its cricondenbar pressure, in which case the feed stream will be cooled to substantial condensation. In addition, it may be advantageous to withdraw the feed stream after cooling to an intermediate temperature, separate any condensed liquid that may have formed, and then expand the vapor stream in a work expansion machine prior to cooling the expanded stream to substantial condensation, similar to the embodiment displayed in FIG. 4. In this case, there was little advantage to work expanding the dense-phase feed stream, so the simpler embodiment shown in FIG. 6 was employed instead.) The resulting cooled stream 71*a* is then flash expanded through an appropriate expansion device, such as expansion valve 52, to the operating pressure (420 psia [2,896 kPa(a)]) of distillation column 56. During expansion a portion of the stream is vaporized, resulting in cooling of the total stream. In the process illustrated in FIG. 6, the expanded stream 71*b* leaving expansion valve 52 reaches a temperature of −143° F. [−97° C.] and is thereafter supplied as feed to distillation column 56 at an intermediate point.

As for the FIG. 4 and FIG. 5 embodiments of the present invention, distillation column 56 serves as an LNG purification tower, recovering nearly all of the carbon dioxide and the hydrocarbons heavier than methane present in its feed stream (stream 71*b*) as its bottom product (stream 77) so that the only significant impurity in its overhead (stream 74) is the nitrogen contained in the feed stream. Reflux for distillation column 56 is created by cooling and condensing the tower overhead vapor (stream 74 at −144° F. [−98° C.]) in heat exchanger 50 by heat exchange with cool LNG flash vapor at −155° F. [−104° C.] (stream 83*a*) and flash liquids at −156° F. [−105° C.] (stream 80). The condensed stream 74*a*, now at −146° F. [−99° C.], is divided into two portions. One portion (stream 78) becomes the feed to the LNG cool-down section. The other portion (stream 75) enters reflux pump 55. After pumping, stream 75*a* at −145° F. [−98° C.] is supplied to LNG purification tower 56 at a top feed point to provide the reflux liquid for the tower. This reflux liquid rectifies the vapors rising up the tower so that the tower overhead (stream 74) and consequently feed stream 78 to the LNG cool-down section contain minimal amounts of carbon dioxide and hydrocarbons heavier than methane.

The feed stream for the LNG cool-down section (condensed liquid stream 78) enters heat exchanger 58 at −146° F. [−99° C.] and is subcooled by heat exchange with cold LNG flash vapor at −255° F. [−159° C.] (stream 83) and cold flash liquids (stream 79*a*). The cold flash liquids are produced by withdrawing a portion of the partially subcooled feed stream (stream 79) from heat exchanger 58 and flash expanding the stream through an appropriate expansion device, such as expansion valve 59, to slightly above the operating pressure of fractionation tower 17. During expansion a portion of the stream is vaporized, resulting in cooling of the total stream from −156° F. [−104° C.] to −160° F. [−106° C.] (stream 79*a*). The flash expanded stream 79*a* is then supplied to heat exchanger 58 as previously described.

The remaining portion of the partially subcooled feed stream is further subcooled in heat exchanger 58 to −169° F. [−112° C.] (stream 82). It then enters a work expansion machine 60 which mechanical energy is extracted from this intermediate pressure stream. The machine 60 expands the subcooled liquid substantially isentropically from a pressure of about 414 psia [2,858 kPa(a)] to the LNG storage pressure (18 psia [124 kPa(a)]), slightly above atmospheric pressure. The work expansion cools the expanded stream 82*a* to a temperature of approximately −255° F. [−159° C.], whereupon it is then directed to LNG storage tank 61 where the flash vapor resulting from expansion (stream 83) is separated from the LNG product (stream 84).

Tower bottoms stream 77 from LNG purification tower 56 is flash expanded to slightly above the operating pressure of fractionation tower 17 by expansion valve 57. During expansion a portion of the stream is vaporized, resulting in cooling of the total stream from −141° F. [−96° C.] to −156° F. [−105° C.] (stream 77*a*). The flash expanded stream 77*a* is then combined with warmed flash liquid stream 79*b* leaving heat exchanger 58 at −155° F. [−104° C.] to form a combined flash liquid stream (stream 80) at −156° F. [−105° C.] which is supplied to heat exchanger 50. It is heated to −90° F. [−68° C.] (stream 80*a*) as it supplies cooling to feed stream 71 and tower overhead vapor stream 74 as described earlier, and thereafter supplied to fractionation tower 17 at a lower mid-column feed point. If desired, stream 80 a can be combined with flash expanded stream 35*a* described earlier and the combined stream supplied to a single lower mid-column feed point on the tower.

The flash vapor (stream 83) from LNG storage tank 61 passes countercurrently to the incoming liquid in heat exchanger 58 where it is heated to −155° F. [−104° C.] (stream 83*a*). It then enters heat exchanger 50 where it is heated to 115° F. [46° C.] (stream 83*b*) as it supplies cooling to feed stream 71 and tower overhead stream 74. Since this stream is at low pressure (15.5 psia [107 kPa(a)]), it must be compressed before it can be used as plant fuel gas. Compressors 63 and 65 (driven by supplemental power sources) with intercooler 64 are used to compress the stream (stream 83*e*). Following cooling in aftercooler 66, stream 83*f* at 115 psia [793 kPa(a)] is combined with stream 37 to become the fuel gas for the plant (stream 85).

The cold distillation vapor stream from the NGL recovery plant (stream 86) is heated to 115° F. [46° C.] as it supplies cooling to feed stream 71 in heat exchanger 50, becoming the second residue gas (stream 86*a*) which is then re-compressed in compressor 62 driven by a supplemental power source. The compressed second residue gas (stream 86*b*) combines with the compressed first residue gas (stream 44*a*) to form third residue gas stream 44. After cooling to 120° F. [49° C.] in discharge cooler 20, third residue gas stream 44*a* is divided into two portions. One portion (stream 71) becomes the feed stream to the LNG production section. The other portion (stream 38) becomes the residue gas product, which flows to the sales gas pipeline at 740 psia [5,102 kPa(a)].

A summary of stream flow rates and energy consumption for the process illustrated in FIG. 6 is set forth in the following table:

TABLE VI (FIG. 6)
Stream Flow Summary - Lb. Moles/Hr [kg moles/Hr]

| Stream | Methane | Ethane | Propane | Butanes+ | Total |
|---|---|---|---|---|---|
| 31 | 35,473 | 1,689 | 585 | 331 | 38,432 |
| 32 | 35,201 | 1,611 | 495 | 178 | 37,835 |
| 35 | 272 | 78 | 90 | 153 | 597 |
| 33 | 9,258 | 424 | 130 | 47 | 9,951 |
| 34 | 25,943 | 1,187 | 365 | 131 | 27,884 |
| 42 | 36,684 | 222 | 6 | 0 | 37,222 |
| 36 | 34,784 | 211 | 6 | 0 | 35,294 |
| 37 | 376 | 2 | 0 | 0 | 382 |
| 71 | 1,923 | 12 | 0 | 0 | 1,951 |
| 74 | 1,229 | 0 | 0 | 0 | 1,242 |
| 77 | 1,173 | 12 | 0 | 0 | 1,193 |
| 75 | 479 | 0 | 0 | 0 | 484 |
| 78 | 750 | 0 | 0 | 0 | 758 |
| 79 | 79 | 0 | 0 | 0 | 80 |
| 83 | 216 | 0 | 0 | 0 | 222 |
| 85 | 592 | 2 | 0 | 0 | 604 |
| 86 | 1,900 | 12 | 0 | 0 | 1,928 |
| 38 | 34,385 | 208 | 6 | 0 | 34,889 |
| 41 | 41 | 1,478 | 579 | 331 | 2,482 |
| 84 | 455 | 0 | 0 | 0 | 456 |

| Recoveries* | | |
|---|---|---|
| Ethane | 87.52% | |
| Propane | 99.05% | |
| Butanes+ | 99.91% | |
| LNG | 50,070 gallons/D<br>7,330 Lbs/H | [417.9 $m^3$/D]<br>[7,330 kg/H] |
| LNG Purity | 99.84% | |
| **Power** | | |
| 1st Residue Gas Compression | 15,315 HP | [25,178 kW] |
| 2nd Residue Gas Compression | 1,124 HP | [1,848 kW] |
| Flash Vapor Compression | 300 HP | [493 kW] |
| Total Gas Compression | 16,739 HP | [27,519 kW] |

*(Based on un-rounded flow rates)

Comparing the recovery levels displayed in Table VI for the FIG. 6 process to those in Table I for the FIG. 1 process shows that the recoveries in the NGL recovery plant have been maintained at essentially the same levels for both processes. The net increase in compression power for the FIG. 6 process compared to the FIG. 1 process is 2,222 HP [3,653 kW] to produce the nominal 50,000 gallons/D [417 $m^3$/D] of LNG, giving a specific power consumption of 0.303 HP-H/Lb [0.498 kW-H/kg] for the FIG. 6 process. Thus, the present invention has a specific power consumption that is lower than both the FIG. 2 and the FIG. 3 prior art processes, with no need for carbon dioxide removal from the feed gas prior to entering the LNG production section like the prior art processes do.

This embodiment of the present invention, which uses the residue gas from the NGL recovery plant as its feed gas, has a lower LNG production efficiency that the FIG. 4 and FIG. 5 embodiments which process a portion of the NGL recovery plant feed gas. This lower efficiency is mainly due to a reduction in the efficiency of the NGL recovery plant as a result of using a portion (stream 86) of the cold distillation vapor (stream 42) from the NGL recovery plant to supply some of the process refrigeration in the LNG production section. Although stream 86 is used in a similar fashion in the FIG. 4 and FIG. 5 embodiments, the NGL recovery plants in these embodiments are processing a lesser quantity of the inlet gas since one portion (stream 71 in FIGS. 4 and 5) is fed to the LNG production section rather than to the NGL recovery plant. The loss in NGL recovery plant efficiency is reflected in the higher utility consumption of first residue gas compressor 19 shown in Table VI for the FIG. 6 process versus the corresponding values in Table IV and Table V for the FIG. 4 and FIG. 5 processes, respectively.

For most inlet gases, the plant inlet gas will be the preferred source of the feed stream for processing according to the present invention, as illustrated in Examples 1 and 2. In some cases, however, the NGL recovery plant residue gas may be the better choice as the source of the feed stream as illustrated in Example 3. For instance, if the inlet gas contains hydrocarbons that may solidify at cold temperatures, such as heavy paraffins or benzene, the NGL recovery plant can serve as a feed conditioning unit for the LNG production section by recovering these compounds in the NGL product. The residue gas leaving the NGL recovery plant will not contain significant quantities of heavier hydrocarbons, so processing a portion of the plant residue gas for co-production of LNG using the present invention can be accomplished in such instances without risk of solids formation in the heat exchangers in the LNG production and LNG cool-down sections. The decision of which embodiment of the present invention to use in a particular circumstance may also be influenced by factors such as inlet gas and residue gas pressure levels, plant size, available equipment, and the economic balance of capital cost versus operating cost.

OTHER EMBODIMENTS

One skilled in the art will recognize that the present invention can be adapted for use with all types of NGL recovery plants to allow co-production of LNG. The examples presented earlier have all depicted the use of the present invention with an NGL recovery plant employing the process disclosed in U.S. Pat. No. 4,278,457 in order to facilitate comparisons of the present invention with the prior art. However, the present invention is generally applicable for use with any NGL recovery process that produces a distillation vapor stream that is at temperatures of −50° F. [−46° C.] or colder. Examples of such NGL recovery processes are described and illustrated in U.S. Pat. Nos. 3,292,380; 4,140,504; 4,157,904; 4,171,964; 4,185,978; 4,251,249; 4,278,457; 4,519,824; 4,617,039; 4,687,499; 4,689,063; 4,690,702; 4,854,955; 4,869,740; 4,889,545; 5,275,005; 5,555,748; 5,568,737; 5,771,712; 5,799,507; 5,881,569; 5,890,378; 5,983,664; 6,182,469; reissue 33,408; and co-pending application No. 60/225,260 and Ser. No. 09/677,220, the full disclosures of which are incorporated by reference herein in their entirety. Further, the present invention is applicable for use with NGL recovery plants that are designed to recover only $C_3$ components and heavier hydrocarbon components in the NGL product (i.e., no significant recovery of $C_2$ components), or with NGL recovery plants that are designed to recover $C_2$ components and heavier hydrocarbon components in the NGL product but are being operated to reject the $C_2$ components to the residue gas so as to recover only $C_3$ components and heavier hydrocarbon components in the NGL product (i.e., ethane rejection mode of operation). This feedstock flexibility is due to LNG purification tower 56 shown in FIGS. 4 through 6, which ensures that only methane (and other volatile gases when present) enters the LNG cool-down section.

Figure 7:
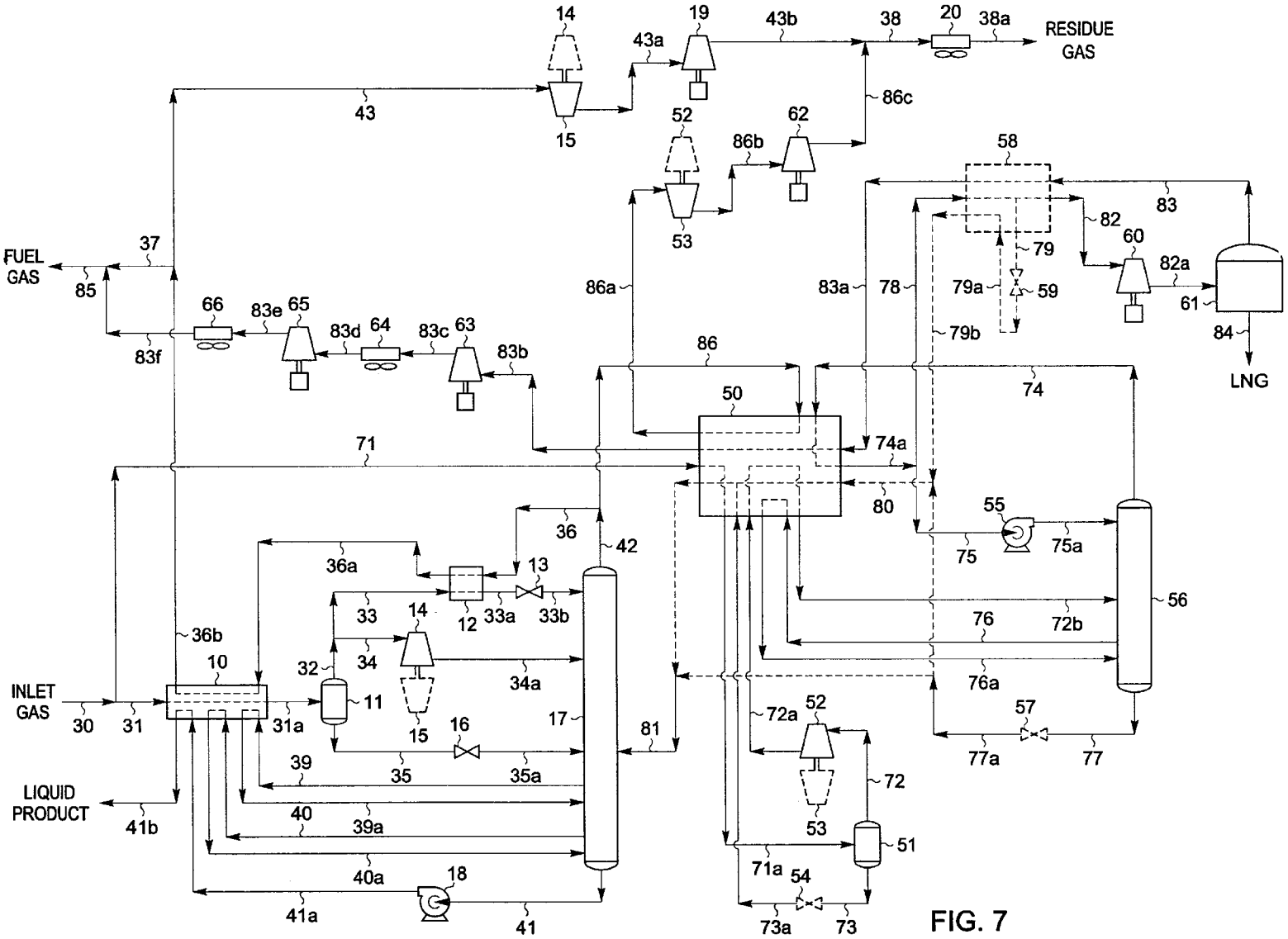
FIG. 7 is a flow diagram illustrating an alternative means of application of the present invention for co-production of LNG from said cryogenic natural gas processing plant.

In accordance with this invention, the cooling of the feed stream to the LNG production section may be accomplished in many ways. In the processes of FIGS. 4 through 6, feed stream 71, expanded stream 72*a* (for the FIG. 4 process only), and distillation vapor stream 74 are cooled and condensed by a portion of the demethanizer overhead vapor (stream 86) along with flash vapor, flash liquid, and tower liquids produced in the LNG production and LNG cool-down sections. However, demethanizer liquids (such as stream 39) could be used to supply some or all of the cooling and condensation of streams 71 and 74 in FIGS. 4 through 6 and/or stream 72*a* in FIG. 4, as could the flash expanded stream 73*a* as shown in FIG. 7. Further, any stream at a temperature colder than the stream(s) being cooled may be utilized. For instance, a side draw of vapor from the demethanizer could be withdrawn and used for cooling. Other potential sources of cooling include, but are not limited to, flashed high pressure separator liquids and mechanical refrigeration systems. The selection of a source of cooling will depend on a number of factors including, but not limited to, feed gas composition and conditions, plant size, heat exchanger size, potential cooling source temperature, etc. One skilled in the art will also recognize that any combination of the above cooling sources or methods of cooling may be employed in combination to achieve the desired feed stream temperature(s).

In accordance with this invention, external refrigeration may be employed to supplement the cooling available to the feed gas from other process streams, particularly in the case of a feed gas richer than that used in Examples 1 and 2. The use and distribution of LNG tower liquids for process heat exchange, and the particular arrangement of heat exchange for feed gas cooling, must be evaluated for each particular application, as well as the choice of process streams for specific heat exchange services.

It will also be recognized that the relative amount of the feed stream 71 that is directed to the LNG cool-down section (stream 78) and that is withdraw to become flash liquid (stream 79) will depend on several factors, including feed gas pressure, feed gas composition, the amount of heat which can economically be extracted from the feed, and the quantity of horsepower available. More feed to the LNG cool-down section may increase LNG production while decreasing the purity of the LNG (stream 84) because of the corresponding decrease in reflux (stream 75) to the LNG purification tower. Increasing the amount that is withdrawn to become flash liquid reduces the power consumption for flash vapor compression but increases the power consumption for compression of the first residue gas by increasing the quantity of recycle to demethanizer 17 in stream 79. Further, as shown by the dashed lines in FIGS. 4 through 7, the flash liquid could be eliminated completely from heat exchanger 58 (at the expense of increasing the quantity of flash vapor in stream 83 and increasing the power consumption for flash vapor compression).

Figure 8:
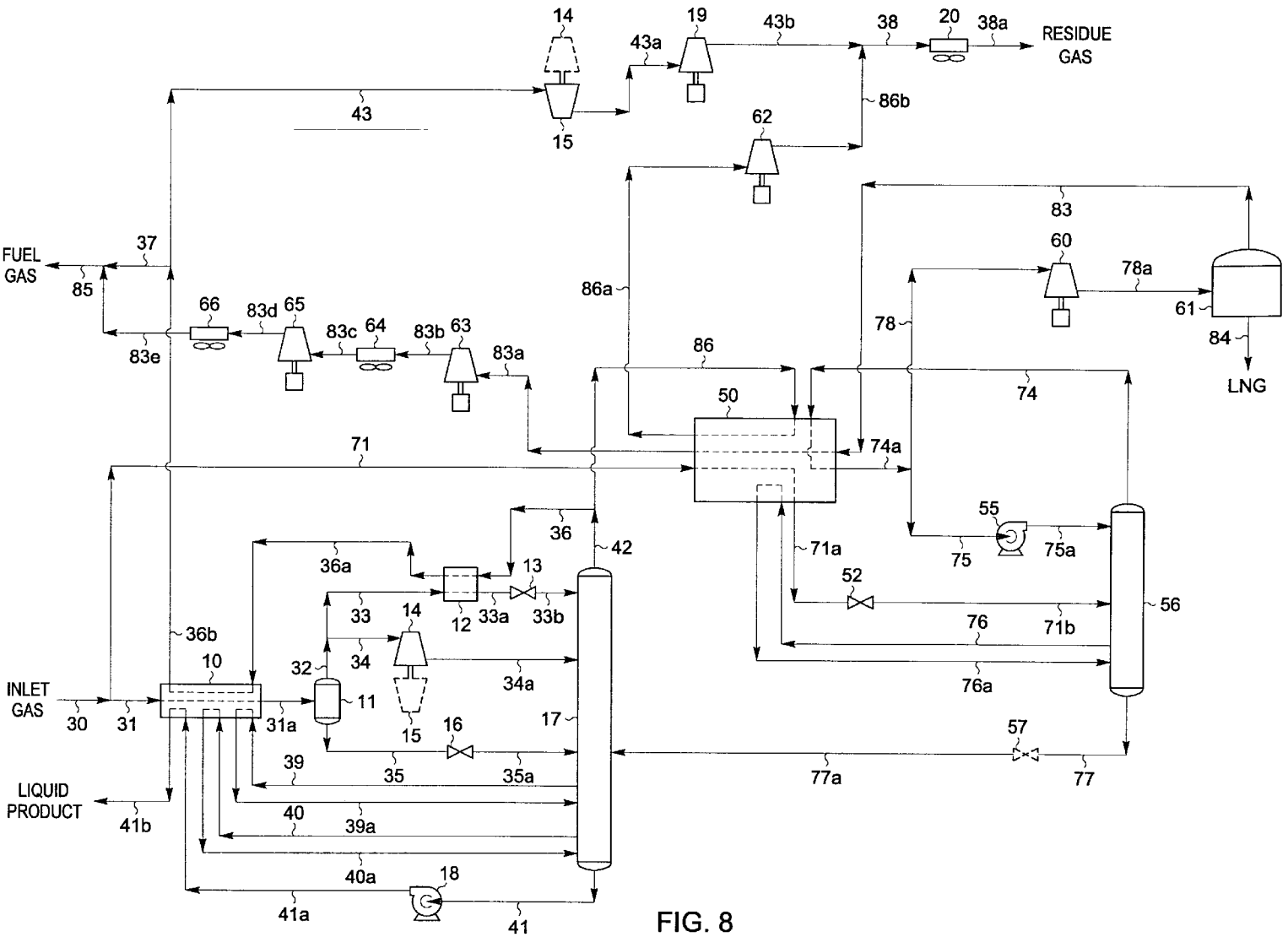
FIG. 8 is a flow diagram illustrating an alternative means of application of the present invention for co-production of LNG from said cryogenic natural gas processing plant.

Subcooling of condensed liquid stream 78 in heat exchanger 58 reduces the quantity of flash vapor (strum 83) generated during expansion of the stream to the operating pressure of LNG storage tank 61. This generally reduces the specific power consumption for producing the LNG by reducing the power consumption of flash gas compressors 63 and 65. However, as illustrated in FIG. 8 and by the dashed lines in FIGS. 4 through 7, some circumstances may favor reducing the capital cost of the facility by eliminating heat exchanger 58 in its entirety. As also illustrated in FIG. 8 and by the dashed lines in FIGS. 4 through 7, the quantity of tower bottoms stream 77 may be such that using the flash expanded stream 77*a* for heat exchange may not be warranted. In such cases, the flash expanded stream 77*a* could be supplied at an appropriate feed location directly to fractionation tower 17 as shown.

Although individual am expansion is depicted in particular expansion devices, alternative expansion means may be employed where appropriate. For example, conditions may warrant work expansion of the substantially condensed feed stream (stream 71*a* in FIGS. 5, 6, and 8) or the LNG purification tower bottoms stream (stream 77 in FIGS. 4 through 8). Further, isenthalpic flash expansion may be used in lieu of work expansion for subcooled liquid stream 82 in FIGS. 4 through 7 or condensed liquid stream 73 in FIG. 8 (with the resultant increase in the relative quantity of flash vapor produced by the expansion, increasing the power consumption for flash vapor compression), or for vapor stream 72 in FIGS. 4 and 7 (with the resultant increase in the power consumption for compression of the second residue gas).

While there have been described what are believed to be preferred embodiments of the invention, those skilled in the art will recognize that other and further modifications may be made thereto, e.g. to adapt the invention to various condition, types of feed or other requirements without departing from the spirit of the present invention.

We claim:

1. A process for liquefying a natural gas stream containing methane and heavier hydrocarbon components wherein (a) said natural gas stream is withdrawn from a cryogenic natural gas processing plant recovering natural gas liquids;

(b) said natural gas stream is cooled under pressure sufficiently to partially condense it;

(c) a distillation stream is withdrawn from said plant to supply at least a portion of said cooling of said natural gas stream;

(d) said partially condensed natural gas stream is separated into a liquid stream and a vapor stream, whereupon said liquid stream is directed to said plant;

(e) said vapor stream is expanded to an intermediate pressure and further cooled at said intermediate pressure to condense it;

(f) said condensed expanded stream is directed to a distillation column at a mid-column feed point;

(g) a liquid distillation stream is withdrawn from a lower region of said distillation column and directed to said plant;

(h) a vapor distillation stream is withdrawn from an upper region of said distillation column and cooled under pressure to condense at least a portion of it and form a condensed stream;

(i) said condensed stream is divided into at least two portions, with a first portion directed to said distillation column at a top feed position;

(j) a second portion of said condensed stream is expanded to lower pressure to form said liquefied natural gas stream; and (k) the temperature of said partially condensed natural gas stream and the quantities and temperatures of said feed streams to said distillation column are effective to maintain the overhead temperature of said distillation column at a temperature whereby the major portion of said heavier hydrocarbon components is recovered in said liquid stream and said liquid distillation stream.

2. A process for liquefying a natural gas stream containing methane and heavier hydrocarbon components wherein (a) said natural gas stream is withdrawn from a cryogenic natural gas processing plant recovering natural gas liquids;

(b) said natural gas stream is cooled under pressure sufficiently to partially condense it;

(c) a distillation stream is withdrawn from said plant to supply at least a portion of said cooling of said natural gas stream;

(d) said partially condensed natural gas stream is separated into a liquid stream and a vapor stream;

(e) said liquid stream is expanded to an intermediate pressure, heated, and thereafter directed to said plant;

(f) said vapor stream is expanded to an intermediate pressure and further cooled at said intermediate pressure to condense it;

(g) said condensed expanded stream is directed to a distillation column at a mid-column feed point;

(h) a liquid distillation stream is withdrawn from a lower region of said distillation column and directed to said plant;

(i) a vapor distillation stream is withdrawn from an upper region of said distillation column and cooled under pressure to condense at least a portion of it and form a condensed stream;

(j) said condensed stream is divided into at least two portions, with a first portion directed to said distillation column at a top feed position;

(k) a second portion of said condensed stream is expanded to lower pressure to form said liquefied natural gas stream; and (l) the temperature of said partially condensed natural gas stream and the quantities and temperatures of said feed streams to said distillation column are effective to maintain the overhead temperature of said distillation column at a temperature whereby the major portion of said heavier hydrocarbon components is recovered in said liquid stream and said liquid distillation stream.

3. A process for liquefying a natural gas stream containing methane and heavier hydrocarbon components wherein (a) said natural gas stream is withdrawn from a cryogenic natural gas processing plant recovering natural gas liquids;

(b) said natural gas stream is cooled under pressure to substantially condense it;

(c) a distillation stream is withdrawn from said plant to supply at least a portion of said cooling of said natural gas stream;

(d) said condensed natural gas stream is expanded to an intermediate pressure and directed to a distillation column at a mid-column feed point;

(e) a liquid distillation stream is withdrawn from a lower region of said distillation column and directed to said plant;

(f) a vapor distillation stream is withdrawn from an upper region of said distillation column and cooled under pressure to condense at least a portion of it and form a condensed stream;

(g) said condensed stream is divided into at least two portions, with a first portion directed to said distillation column at a top feed position;

(h) a second portion of said condensed stream is expanded to lower pressure to form said liquefied natural gas stream; and (i) the quantities and temperatures of said feed streams to said distillation column are effective to maintain the overhead temperature of said distillation column at a temperature whereby the major portion of said heavier hydrocarbon components is recovered in said liquid distillation stream.

4. The improvement according to claim 1, 2, or 3 wherein said second portion of said condensed stream is cooled before being expanded to said lower pressure.

5. The improvement according to claim 4 wherein a third portion of said condensed stream is withdrawn, expanded to an intermediate pressure, and directed in heat exchange relation with said second portion of said condensed stream to supply at least a portion of said cooling.

6. The improvement according to claim 1, 2, or 3 wherein said liquid distillation stream is expanded and heated before being directed to said plant.

7. The improvement according to claim 4 wherein said liquid distillation stream is expanded and heated before being directed to said plant.

8. The improvement according to claim 5 wherein said liquid distillation stream is expanded and heated before being directed to said plant.

9. An apparatus for liquefying a natural gas stream containing methane and heavier hydrocarbon components comprising (a) first withdrawing means connected to a cryogenic natural gas processing plant recovering natural gas liquids to withdraw said natural gas stream;

(b) first heat exchange means connected to said first withdrawing means to receive said natural gas stream and cool it under pressure sufficiently to partially condense it;

(c) second withdrawing means connected to said plant to withdraw a distillation stream, said second withdrawing means being further connected to said first heat exchange means to heat said distillation stream and thereby supply at least a portion of said cooling of said natural gas stream;

(d) separation means connected to said first heat exchange means to receive said partially condensed natural gas stream and to separate it into a vapor stream and a liquid stream, whereupon said liquid stream is directed to said plant;

(e) first expansion means connected to said separation means to receive said vapor stream and expand it to an intermediate pressure, said first expansion means being further connected to said first heat exchange means to supply said expanded vapor stream to said first heat exchange means, with said first heat exchange means being adapted to further cool said expanded vapor stream at said intermediate pressure to substantially condense it;

(f) a distillation column connected to said first heat exchange means to receive said substantially condensed expanded stream at a mid-column feed point, with said distillation column adapted to withdraw a liquid distillation stream from a lower region of said distillation column and direct it to said plant, and to withdraw a vapor distillation stream from an upper region of said distillation column, said distillation column being further connected to said first heat exchange means to supply said vapor distillation stream to said first heat exchange means, with said first heat exchange means being adapted to cool said vapor distillation stream under pressure, thereby to condense at least a portion of it and form a condensed stream;

(g) dividing means connected to said first heat exchange means to receive said condensed stream and divide it into at least two portions, said dividing means being further connected to said distillation column to direct a first portion of said condensed stream to said distillation column at a top feed position;

(h) second expansion means connected to said dividing means to receive a second portion of said condensed stream and expand it to lower pressure to form said liquefied natural gas stream; and (i) control means adapted to regulate the temperature of said partially condensed natural gas stream and the quantities and temperatures of said feed streams to said distillation column to maintain the overhead temperature of said distillation column at a temperature whereby the major portion of said heavier hydrocarbon components is recovered in said liquid stream and said liquid distillation stream.

10. An apparatus for liquefying a natural gas stream containing methane and heavier hydrocarbon components comprising (a) first withdrawing means connected to a cryogenic natural gas processing plant recovering natural gas liquids to withdraw said natural gas stream;

(b) first heat exchange means connected to said first withdrawing means to receive said natural gas stream and cool it under pressure sufficiently to partially condense it;

(c) second withdrawing means connected to said plant to withdraw a distillation stream, said second withdrawing means being further connected to said first heat exchange means to heat said distillation stream and thereby supply at least a portion of said cooling of said natural gas stream;

(d) separation means connected to said first heat exchange means to receive said partially condensed natural gas stream and to separate it into a vapor stream and a liquid stream;

(e) first expansion means connected to said separation means to receive said vapor stream and expand it to an intermediate pressure, said first expansion means being further connected to said first heat exchange means to supply said expanded vapor stream to said first heat exchange means, with said first heat exchange means being adapted to further cool said expanded vapor stream at said intermediate pressure to substantially condense it;

(f) a distillation column connected to said first heat exchange means to receive said substantially condensed expanded stream at a mid-column feed point, with said distillation column adapted to withdraw a liquid distillation stream from a lower region of said distillation column and direct it to said plant, and to withdraw a vapor distillation stream from an upper region of said distillation column, said distillation column being further connected to said first heat exchange means to supply said vapor distillation stream to said first heat exchange means, with said first heat exchange means being adapted to cool said vapor distillation stream under pressure, thereby to condense at least a portion of it and form a condensed stream;

(g) dividing means connected to said first heat exchange means to receive said condensed stream and divide it into at least two portions, said dividing means being further connected to said distillation column to direct a first portion of said condensed stream to said distillation column at a top feed position;

(h) second expansion means connected to said dividing means to receive a second portion of said condensed stream and expand it to lower pressure to form said liquefied natural gas stream;

(i) third expansion means connected to said separation means to receive said liquid stream and expand it to an intermediate pressure, said third expansion means being further connected to said first heat exchange means to heat said expanded liquid stream and thereby supply at least a portion of said cooling, with said expanded heated liquid stream thereafter directed to said plant; and (j) control means adapted to regulate the temperature of said partially condensed natural gas stream and the quantities and temperatures of said feed streams to said distillation column to maintain the overhead temperature of said distillation column at a temperature whereby the major portion of said heavier hydrocarbon components is recovered in said liquid stream and said liquid distillation stream.

11. An apparatus for liquefying a natural gas stream containing methane and heavier hydrocarbon components comprising (a) first withdrawing means connected to a cryogenic natural gas processing plant recovering natural gas liquids to withdraw said natural gas stream;

(b) first heat exchange means connected to said first withdrawing means to receive said natural gas stream and cool it under pressure to substantially condense it;

(c) second withdrawing means connected to said plant to withdraw a distillation stream, said second withdrawing means being further connected to said first heat exchange means to heat said distillation stream and thereby supply at least a portion of said cooling of said natural gas stream;

(d) first expansion means connected to said first heat exchange means to receive said substantially condensed stream and expand it to an intermediate pressure;

(e) a distillation column connected to said first expansion means to receive said expanded stream at a mid-column feed point, with said distillation column adapted to withdraw a liquid distillation stream from a lower region of said distillation column and direct it to said plant, and to withdraw a vapor distillation stream from an upper region of said distillation column, said distillation column being further connected to said first heat exchange means to supply said vapor distillation stream to said first heat exchange means, with said first heat exchange means being adapted to cool said vapor distillation stream under pressure, thereby to condense at least a portion of it and form a condensed stream;

(f) dividing means connected to said first heat exchange means to receive said condensed stream and divide it into at least two portions, said dividing means being further connected to said distillation column to direct a first portion of said condensed stream to said distillation column at a top feed position;

(g) second expansion means connected to said dividing means to receive a second portion of said condensed stream and expand it to lower pressure to form said liquefied natural gas stream; and (h) control means adapted to regulate the quantities and temperatures of said feed streams to said distillation column to maintain the overhead temperature of said distillation column at a temperature whereby the major portion of said heavier hydrocarbon components is recovered in said liquid distillation stream.

12. The improvement according to claim 9 or 11 wherein a second heat exchange means is connected to said dividing means to receive said second portion of said condensed stream and cool it, said second heat exchange means being further connected to supply said cooled second portion to said second expansion means.

13. The improvement according to claim 10 wherein a second heat exchange means is connected to said dividing means to receive said second portion of said condensed stream and cool it, said second heat exchange means being further connected to supply said cooled second portion to said second expansion means.

14. The improvement according to claim 12 wherein a third withdrawing means is connected to said second heat exchange means to withdraw a third portion of said condensed stream from said cooled second portion, said third withdrawing means being further connected to supply said third portion to a third expansion means and expand it to an intermediate pressure, said third expansion means being further connected to supply said expanded third portion to said second heat exchange means to supply at least a portion of said cooling.

15. The improvement according to claim 13 wherein a third withdrawing means is connected to said second heat exchange means to withdraw a third portion of said condensed stream from said cooled second portion, said third withdrawing means being further connected to supply said third portion to a fourth expansion means and expand it to an intermediate pressure, said fourth expansion means being further connected to supply said expanded third portion to said second heat exchange means to supply at least a portion of said cooling.

16. The improvement according to claim 9 or 11 wherein a third expansion means is connected to said distillation column to receive said liquid distillation stream and expand it, said third expansion means being further connected to said first heat exchange means to heat said expanded liquid distillation stream and thereby supply at least a portion of said cooling, with said expanded heated liquid distillation stream thereafter directed to said plant.

17. The improvement according to claim 10 wherein a fourth expansion means is connected to said distillation column to receive said liquid distillation stream and expand it, said fourth expansion means being further connected to supply said expanded liquid distillation stream to said first heat exchange means to heat said expanded liquid distillation stream and thereby supply at least a portion of said cooling, with said expanded heated liquid distillation stream thereafter directed to said plant.

18. The improvement according to claim 12 wherein a third expansion means is connected to said distillation column to receive said liquid distillation stream and expand it, said third expansion means being further connected to supply said expanded liquid distillation stream to said first heat exchange means to heat said expanded liquid distillation stream and thereby supply at least a portion of said cooling, with said expanded heated liquid distillation stream thereafter directed to said plant.

19. The improvement according to claim 13 wherein a fourth expansion means is connected to said distillation column to receive said liquid distillation stream and expand it, said fourth expansion means being further connected to supply said expanded liquid distillation stream to said first heat exchange means to heat said expanded liquid distillation stream and thereby supply at least a portion of said cooling, with said expanded heated liquid distillation stream thereafter directed to said plant.

20. The improvement according to claim 14 wherein a fourth expansion means is connected to said distillation column to receive said liquid distillation stream and expand it, said fourth expansion means being further connected to supply said expanded liquid distillation stream to said first heat exchange means to heat said expanded liquid distillation stream and thereby supply at least a portion of said cooling, with said expanded heated liquid distillation stream thereafter directed to said plant.

21. The improvement according to claim 15 wherein a fifth expansion means is connected to said distillation column to receive said liquid distillation stream and expand it, said fifth expansion means being further connected to supply said expanded liquid distillation stream to said first heat exchange means to heat said expanded liquid distillation stream and thereby supply at least a portion of said cooling, with said expanded heated liquid distillation stream thereafter directed to said plant.

* * * * *

UNITED STATES PATENT AND TRADEMARK OFFICE

CERTIFICATE OF CORRECTION

PATENT NO. : 6,526,777 B1
DATED : March 4, 2003
INVENTOR(S) : Campbell et al.

It is certified that error appears in the above-identified patent and that said Letters Patent is hereby corrected as shown below:

Title page,
Item [73], Assignee, "Elcor Corporation," should read -- ELKCORP --

Column 2,
Line 28, "cryogemc" should read -- cryogenic --

Column 5,
Line 2, "exchange" should read -- exchanger --

Column 8,
Line 5, "3,355" should read -- 7,397 --

Column 26,
Line 58, "withdraw" should read -- withdrawn --

Column 27,
Line 10, "strum" should read -- stream --
Line 25, "am" should read -- stream --

Signed and Sealed this

Twenty-sixth Day of August, 2003

JAMES E. ROGAN
*Director of the United States Patent and Trademark Office*